US006222571B1

(12) United States Patent
Sasaki et al.

(10) Patent No.: US 6,222,571 B1
(45) Date of Patent: Apr. 24, 2001

(54) COLOR THERMAL PRINTER AND COLOR THERMAL PRINTING METHOD

(75) Inventors: Hidemi Sasaki; Naoki Takatori; Akimasa Kaya, all of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/053,779

(22) Filed: Apr. 2, 1998

(30) Foreign Application Priority Data

Apr. 3, 1997 (JP) ..... 9-084996
Apr. 3, 1997 (JP) ..... 9-084997
Sep. 2, 1997 (JP) ..... 9-236666

(51) Int. Cl.[7] ..... B41J 2/32
(52) U.S. Cl. ..... 347/175
(58) Field of Search ..... 347/175, 202

(56) References Cited

U.S. PATENT DOCUMENTS 5,463,417 10/1995 Yamakawa ..... 347/212
5,629,729 * 5/1997 Fujishiro ..... 347/175

FOREIGN PATENT DOCUMENTS 6-155777 * 6/1994 (JP) ..... 347/175
8-174883 7/1996 (JP) ..... B41J/2/325

* cited by examiner

*Primary Examiner*—Huan Tran
(74) *Attorney, Agent, or Firm*—Sughrue, Mion, Zinn, Macpeak & Seas, PLLC

(57) ABSTRACT

A thermal printer is used with thermosensitive recording sheet. The recording sheet includes a support, and at least one thermosensitive coloring layer, formed on the support, colorable with heat, and fixable with violet or ultraviolet rays. The recording sheet has a recording region, and first and second lateral sides between which the recording region is disposed. The thermal printer includes a feeder roller set for conveying the recording sheet along a conveying path. The first and second lateral sides are set to extend in a direction of the conveying path. A thermal head applies the heat to the coloring layer during conveyance of the recording sheet along the conveying path, to record an image. A fixer applies the violet or ultraviolet rays to the recording sheet being colored during conveyance of the recording sheet along the conveying path, to fix the coloring layer. At least two guide tooth portions, being first and second, are disposed between the fixer and the recording sheet, and guide respectively the first and second lateral sides along the conveying path. There are first and second gaps respectively defined adjacent to the first and second guide tooth portions. The first and second gaps allow the violet or ultraviolet rays to pass between the fixer and the recording sheet, to fix the first and second lateral sides.

26 Claims, 31 Drawing Sheets

COLOR THERMAL PRINTER AND COLOR THERMAL PRINTING METHOD

BACKGROUND OF THE INVENTION

1. Field of the Invention

The present invention relates to a color thermal printer and color thermal printing method. More particularly, the present invention relates to a color thermal printer and color thermal printing method in which the entire surface of color thermosensitive recording material after recording can be fixed and bleached.

2. Description Related to the Prior Art

A direct type of a color thermal printer is known in the field of thermal recording, and is operated to record a full-color image in a three-color frame-sequential method. A full-color thermosensitive recording material of a direct recording type is used, which includes a support, a cyan thermosensitive coloring layer, a magenta thermosensitive coloring layer and a yellow thermosensitive coloring layer. The yellow coloring layer among those has the highest heat sensitivity. The cyan coloring layer has the lowest heat sensitivity. Three-color images are recorded in the order of yellow, magenta and cyan. In order to avoid further coloring of the yellow coloring component in the course of the magenta recording, a yellow fixer lamp emanates visible violet rays or near ultraviolet rays in a wavelength range peaking at the wavelength of 420 nm, and fixes the yellow coloring layer of the recording material. In order to avoid further coloring of the magenta coloring component in the course of the cyan recording, the magenta fixer lamp emanates ultraviolet rays in a wavelength range peaking at the wavelength of 365 nm, and fixes the magenta coloring layer. As unrecorded regions on the recording material defined around the full-color image has a very light yellow-greenish color, the magenta fixer lamp is driven after the cyan recording to apply rays to all the unrecorded portions to bleach them.

The direct type of the thermal recording has an advantage in that no ink ribbon is used, in contrast to the melt-type or wax transfer type of thermal transfer printer. The direct type does not have any mechanism for feeding ink ribbon, and is mechanically simpler. However the set of the fixer lamps is required for fixation of the yellow and magenta coloring layers.

If the thermal printer has the fixer lamps disposed higher than the recording material, the entire surface of the recording material can receive application of fixing rays. But if a thermal printer has the fixer lamps disposed lower than the recording material, the thermal printer requires guide members for supporting the recording material in contact with its lower surface. The guide members have shapes for supporting only lateral sides of the recording material as viewed in the width direction, for sufficient fixation. Unfixed regions in a belt-shape remain on the lateral sides of the recording material after the recording material is fixed in passage through the guide members. If it is desired to bleach the unfixed regions, an additional ultraviolet lamp must be used for bleaching the recording material having been conveyed out of the guide members. The requirement of the additional lamp is unadvantageous, as it is inconsistent to the small cost and the structural simplicity.

SUMMARY OF THE INVENTION

In view of the foregoing problems, an object of the present invention is to provide a color thermal printer and color thermal printing method in which the entire surface of color thermosensitive recording material after recording can be fixed and bleached.

Another object of the present invention is to provide a color thermal printer and color thermal printing method in which a user can be caused to recognize a finish of the printing operation.

Still another object of the present invention is to provide a color thermal printer and color thermal printing method in which a margin of the recording sheet is fixed and bleached with increased efficiency.

In order to achieve the above and other objects and advantages of this invention, a thermal printer is used with thermosensitive recording material, the recording material including a support, and at least one thermosensitive coloring layer, formed on the support, colorable with heat, and fixable with electromagnetic rays, the recording material having a recording region, and first and second lateral sides between which the recording region is disposed. The thermal printer includes a feeder unit for conveying the recording material along a conveying path, the first and second lateral sides being set to extend in a direction of the conveying path. A thermal head applies the heat to the coloring layer during conveyance of the recording material along the conveying path, to record an image. A fixer applies the electromagnetic rays to the recording material being colored during conveyance of the recording material along the conveying path, to fix the coloring layer. At least two guide tooth portions, being first and second, are disposed between the fixer and the recording material, for guiding respectively the first and second lateral sides along the conveying path, there being first and second gaps respectively defined adjacent to the first and second guide tooth portions, the first and second gaps allowing the electromagnetic rays to pass between the fixer and the recording material, to fix the first and second lateral sides, In a preferred embodiment, the first and second guide tooth portions are transparent.

The thermal head and the fixer are disposed under the conveying path, and the recording material is conveyed with the support upwards oriented.

The recording material includes first and second margins, the recording region being surrounded by the first and second lateral sides and the first and second margins. The feeder unit conveys the recording material by advancing either of the first and second margins along the conveying path. Furthermore a controller (i.e., means for controlling) controls the feeder unit and the fixer, wherein the controller causes the feeder unit to convey the recording region past the fixer, and while the recording region is conveyed, causes the fixer to apply the electromagnetic rays to the recording region for fixing the recording region, and then causes the feeder unit to convey the first margin past the fixer, and while the first margin is conveyed, causes the fixer to apply the electromagnetic rays to the first margin for fixing the first margin, thereby the first and second lateral sides being fixed entirely through the first and second gaps.

The at least one coloring layer comprises at least first to third coloring layers colorable in colors different from each other, the first coloring layer being disposed at a recording surface, the third coloring layer being disposed deepest from the recording surface, and the first and second coloring layers being fixable with the electromagnetic rays of respectively first and second wavelength ranges. The fixer includes a first fixer lamp for emanating the electromagnetic rays of the first wavelength range, to fix the first coloring layer. A second fixer lamp emanates the electromagnetic rays of the second wavelength range, to fix the second coloring layer, the second fixer lamp applying the electromagnetic rays of the second wavelength range to the recording region and afterwards to the first margin, thereby the first margin being fixed and bleached.

Each of the first and second guide tooth portions includes plural teeth arranged in a comb shape, and there are gaps defined between the plural teeth to constitute the first and second gaps.

The controller causes the feeder unit to convey the recording region at a first speed past the fixer, for fixation of the recording region, and causes the feeder unit to convey the first margin at a second speed smaller than the first speed, past the fixer, for fixing and bleaching the first margin.

The controller causes the feeder unit to convey the first margin intermittently past the fixer, for fixing and bleaching the first margin.

The thermal printer further includes a printer body. An entrance opening is formed in the printer body, for allowing the recording material to move into and out of the printer body. The feeder unit supplies the printer body with the recording material by advancing the first margin, and after recording and fixation of the recording material, ejects the recording material from the entrance opening by advancing the second margin.

The conveying path includes a supply passageway for supplying the recording material in advancement of the first margin is advanced therethrough. A print passageway is formed to extend downstream from the supply passageway, and has the thermal head, the fixer and the first and second guide tooth portions, the feeder unit conveying the recording material back and forth therethrough. An ejection passageway is formed to extend from the print passageway in a position between the supply passageway and the print passageway, for ejecting the recording material in advancement of the second margin after the recording material is conveyed through the print passageway.

In still another preferred embodiment, the controller, after the electromagnetic rays are applied to the recording region, causes the feeder unit to confront the first margin with the fixer, causes the feeder unit to convey the recording material back and forth within a predetermined stroke range, and while the recording material is conveyed back and forth, causes the fixer to apply the electromagnetic rays to the first margin to fix the first margin.

In another preferred embodiment, the controller, after the electromagnetic rays are applied to the recording region, causes the feeder unit to confront the first margin with the fixer, causes the feeder unit to convey the recording material intermittently, and while the recording material is conveyed intermittently, causes the fixer to apply the electromagnetic rays to the first margin to fix the first margin.

In an additional preferred embodiment, the controller, before the heat is applied to the coloring layer, stops the feeder unit and the recording material with the first margin confronted with the fixer, and while the first margin is confronted with the fixer, causes the fixer to apply the electromagnetic rays to the first margin to fix the first margin.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
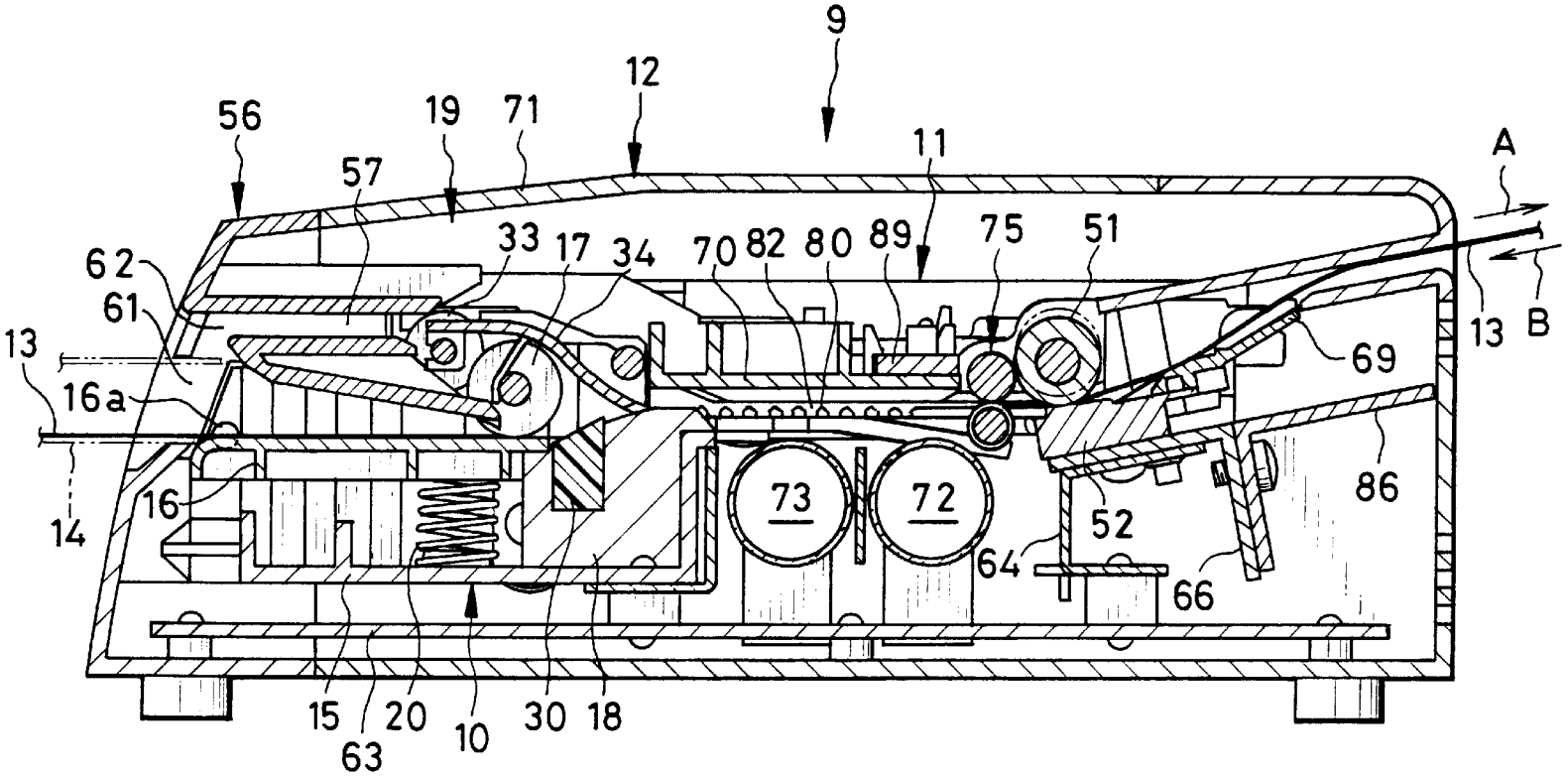
FIG. 1 is a cross section illustrating a color thermal printer.
Figure 2:
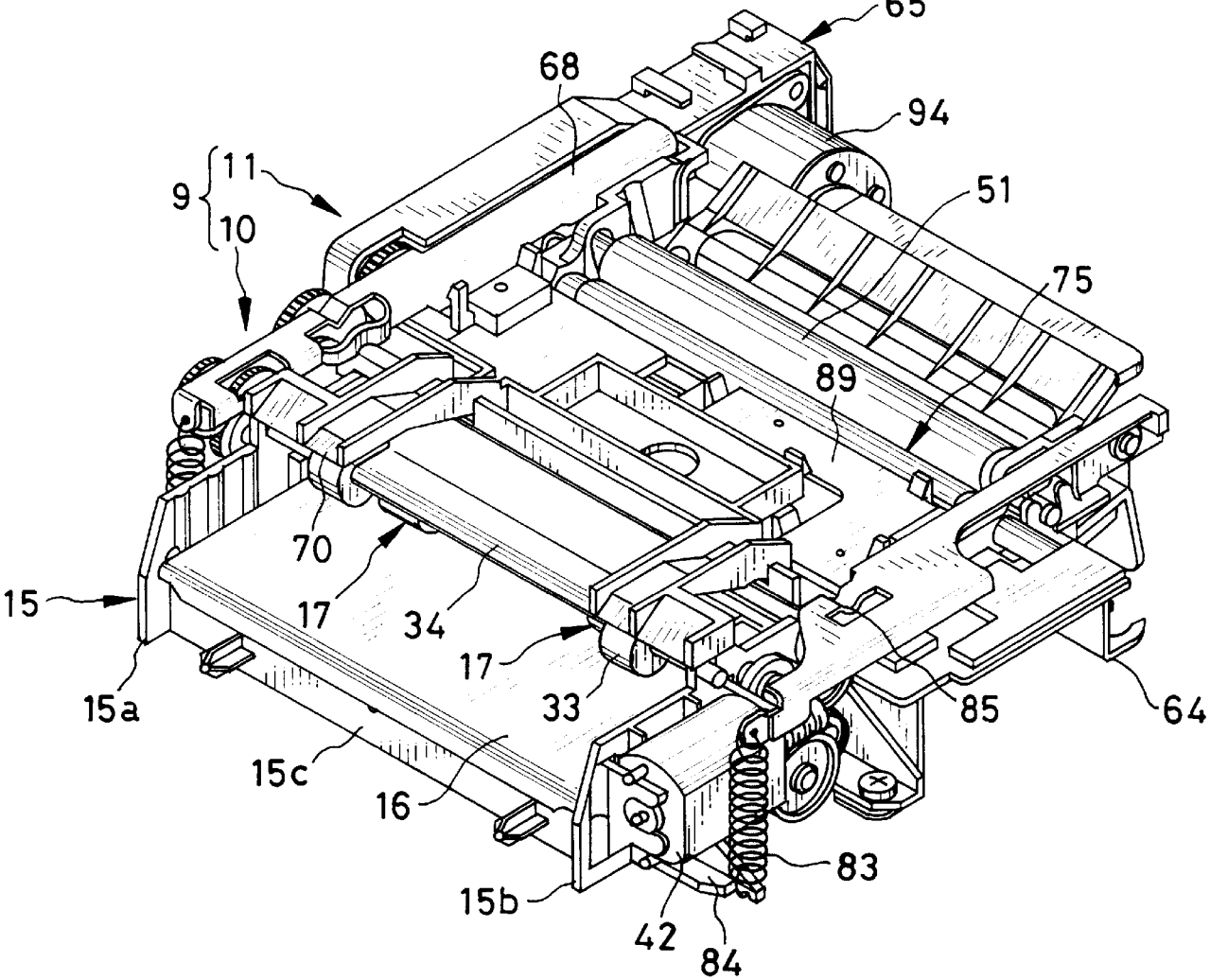
FIG. 2 is a perspective illustrating a combination of a supply unit and a print unit.
Figure 3:
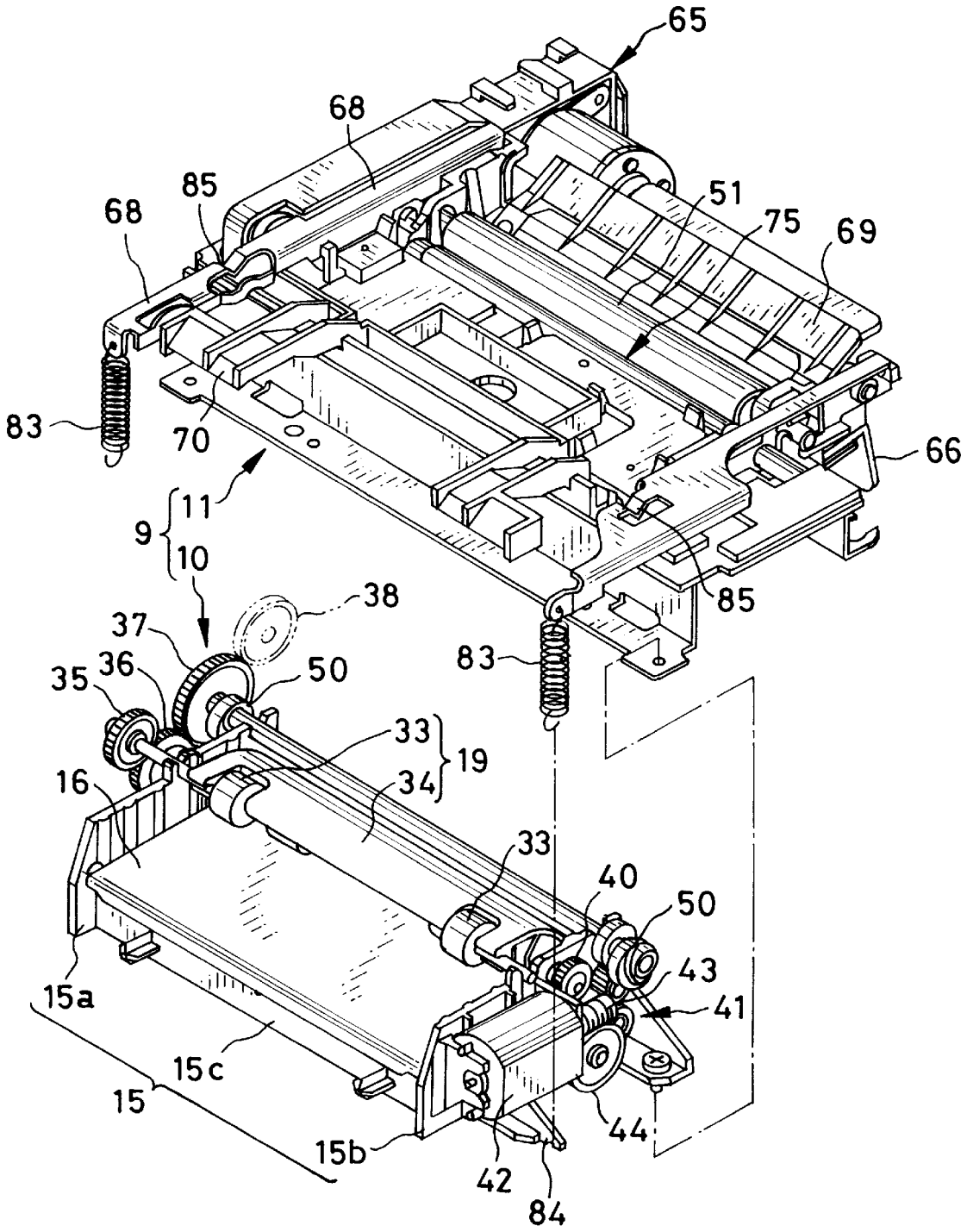
FIG. 3 is an exploded perspective illustrating the supply unit and the print unit separated from each other.

In FIGS. 1, 2 and 3, a color thermal printer 9 of the present invention is constituted by a sheet supply unit 10, a print unit 11 and a cabinet or printer body 12. The supply unit 10 is mounted on a supply side of the print unit 11 in a unified manner. The supply unit 10 and the print unit 11 are incorporated in the printer body 12. One color thermosensitive recording sheet 13 is manually set on the supply unit 10. Also a supply cassette 14 can be used instead of manual insertion of the recording sheet 13. The supply cassette 14 contains a plurality of recording sheets to cause them to be automatically supplied for the print unit 11.

Figure 1A:
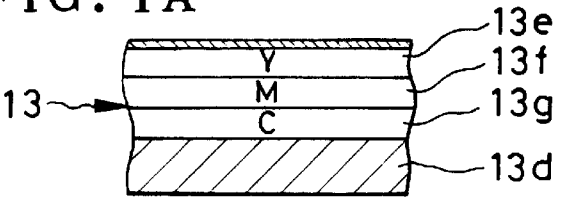
FIG. 1A is a cross section illustrating a structure of layers of a color thermosensitive recording sheet.

The recording sheet 13 is a full-color thermosensitive recording sheet of a direct recording type having optical fixability, and known in the art. In FIG. 1A, the recording sheet 13 includes a support 13*d*, a cyan thermosensitive coloring layer 13*g*, a magenta thermosensitive coloring layer 13*f* and a yellow thermosensitive coloring layer 13*e*. The yellow coloring layer 13*e* among those has the highest heat sensitivity. The cyan coloring layer 13*g* has the lowest heat sensitivity. The coloring ability of the yellow coloring layer 13*e* is destroyed when visible violet rays or near ultraviolet rays with a wavelength of 420 nm is applied to it. The coloring ability of the magenta coloring layer 13*f* is destroyed when ultraviolet rays with a wavelength of 365 nm is applied to it.

Figure 4:
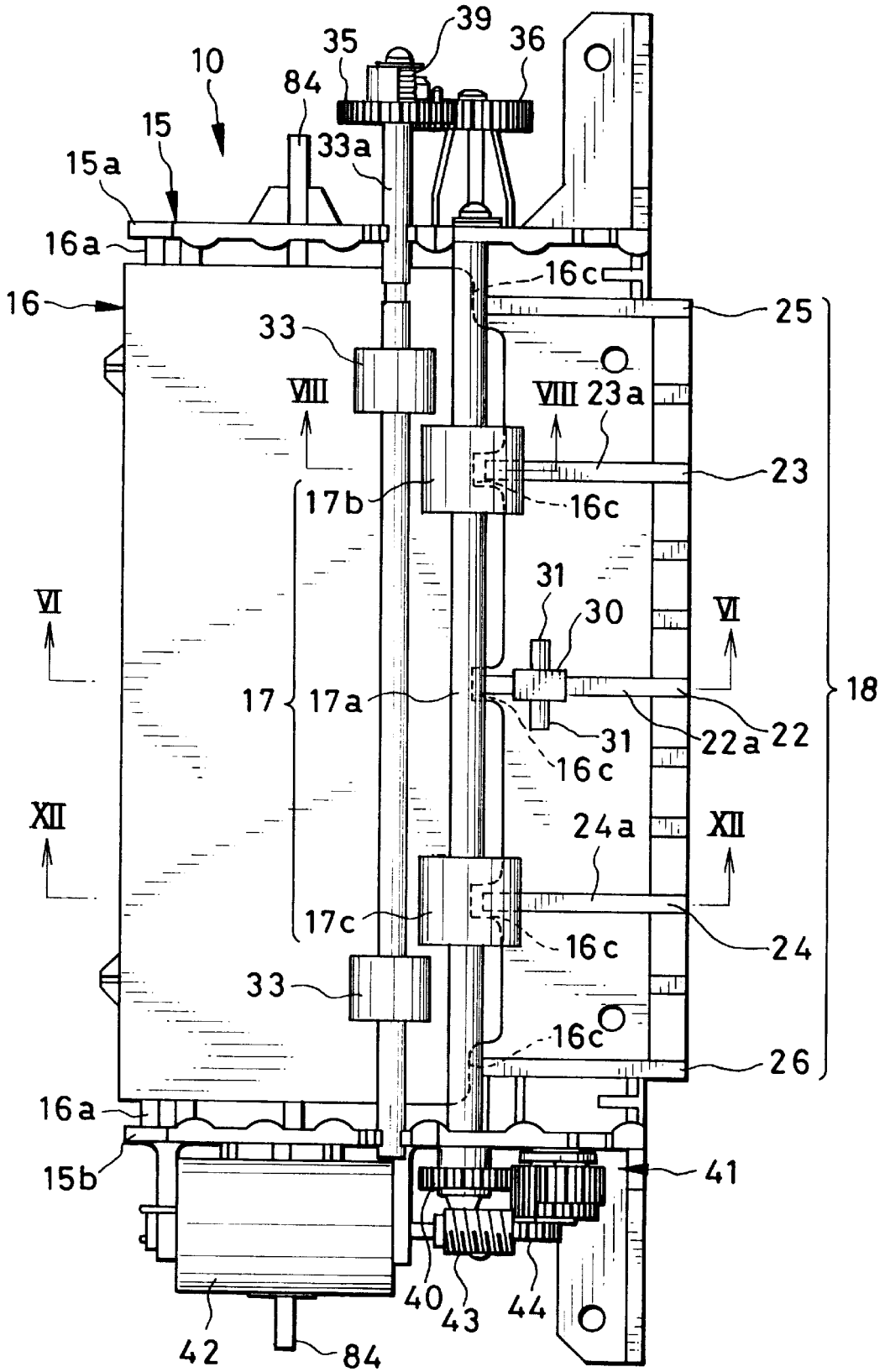
FIG. 4 is a top plan illustrating the supply unit.

In FIGS. 2–4, the supply unit 10 is constituted by a supply frame 15, a supply plate 16, a supply roller 17, a supply guide unit 18 and an ejector 19. The supply plate 16 operates as a supply passageway included in a conveying path. The supply frame 15 is constituted by a pair of side plates 15*a* and 15*b* and a base plate 15*c* for connecting them to one another.

Figure 5:
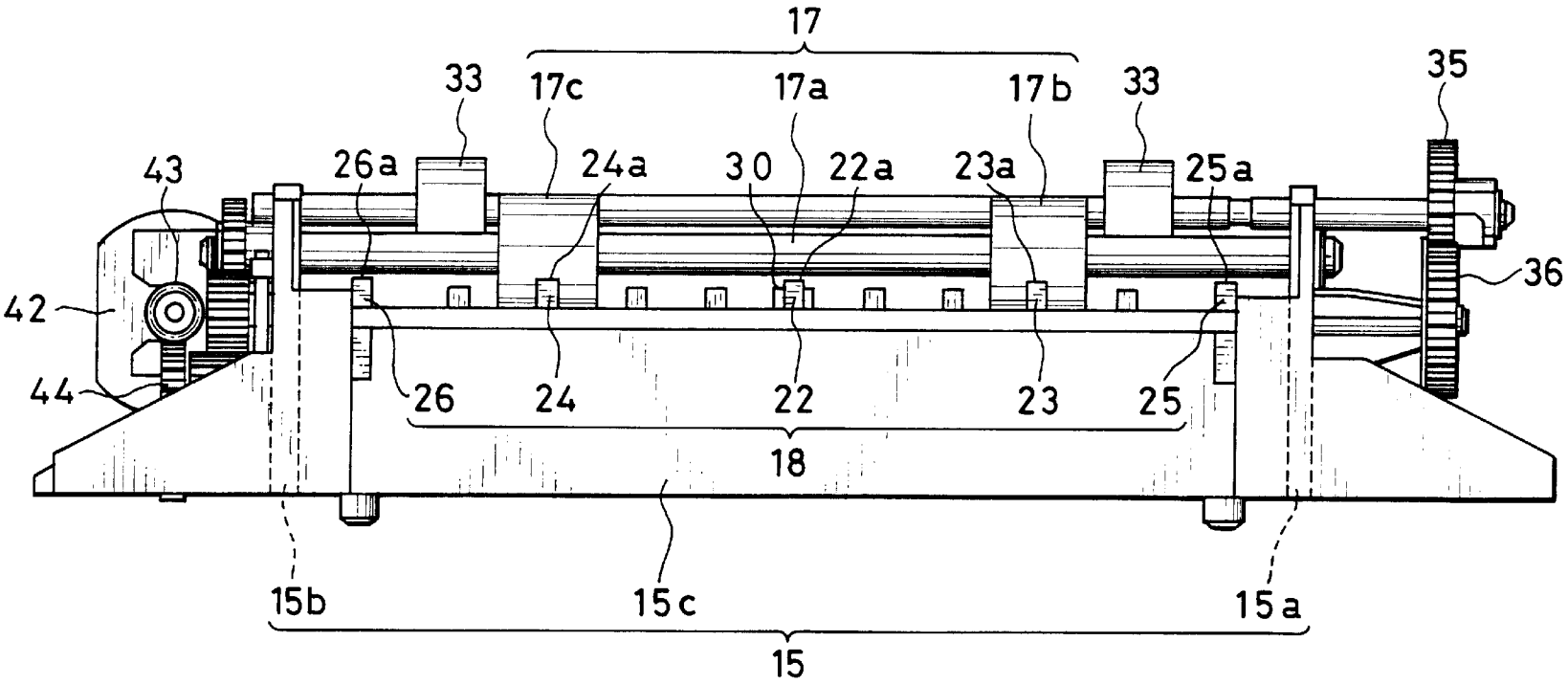
FIG. 5 is a rear elevation illustrating the supply unit.
Figure 6:
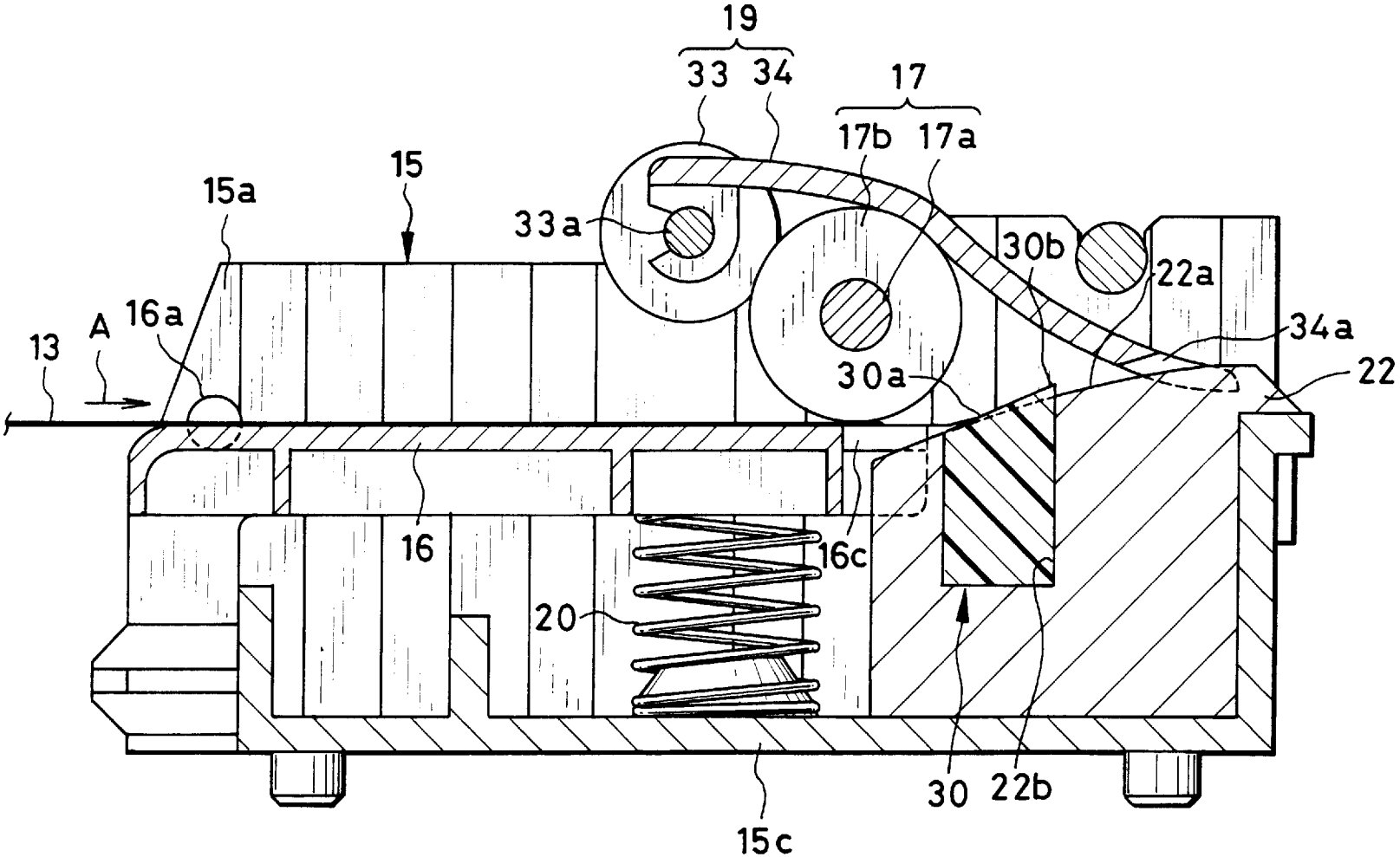
FIG. 6 is a cross section taken on line VI—VI of FIG. 4, illustrating a guide mechanism of the supply unit.
Figure 7:
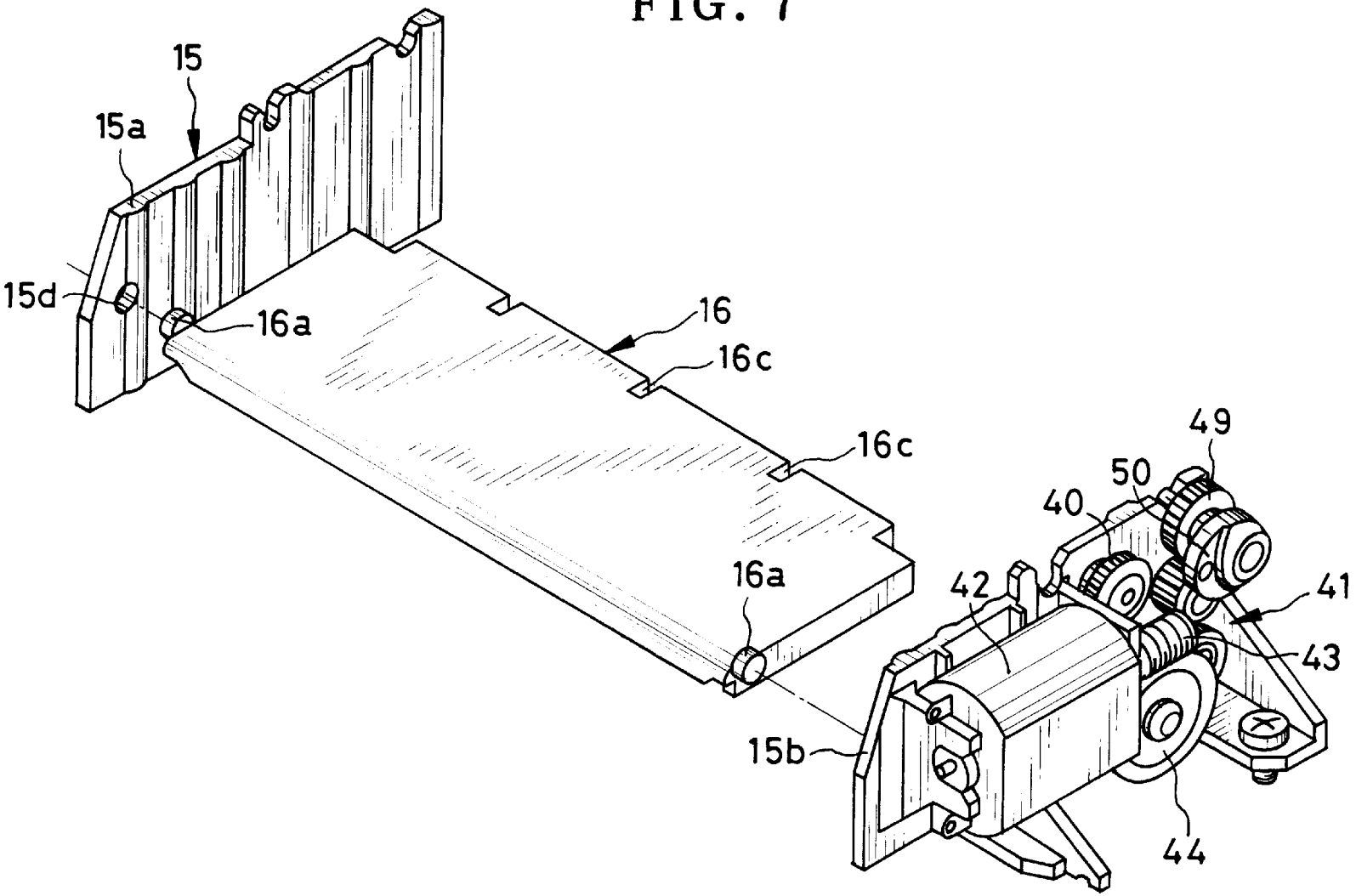
FIG. 7 is an exploded perspective illustrating an assembling state of a supply plate.

In FIGS. 4–6, the supply plate 16 is disposed in the supply frame 15 in a manner pivotal about a support shaft 16*a*. The supply plate 16 is biased up by a coil spring 20, and presses the recording sheet 13 against the supply roller 17. In FIG. 7, the support shaft 16*a* of the supply plate 16 is so kept that its center is located on a plane surface of the supply plate 16 for supporting the recording sheet. Consequently an upper half of the support shaft 16*a* protrudes over the plane surface of the supply plate 16. The support shaft 16*a* has a rod shape being cylindrical. Note that the support shaft 16*a* may have a semi-cylindrical shape, which would consist of only a lower half of the rod shape as depicted.

The support shaft 16*a* is received in an axial hole 15*d* formed in the supply frame 15 in a rotatable manner. However an axial receiving portion may be formed with the supply frame 15 for receiving the support shaft 16*a* in a rotatable manner. The axial receiving portion may have any suitable shape, for example cylindrical or semi-cylindrical. The disposition of the support shaft 16*a* on the plane of the supply plate 16 for supporting the recording sheet makes it possible that the recording sheet can be pressed on the supply roller reliably even when a small number of recording sheets remain on the supply plate 16. The recording sheet can be prevented from dropping away from the supply roller.

The supply roller 17 is disposed over an end of the supply plate 16. The supply roller 17 is constituted by a roller shaft 17*a* and two rubber rolls 17*b* and 17*c*, which are disposed on the supply roller 17 and away from each other. The supply roller 17 rotates in contact with an uppermost one of the plural recording sheets placed on the supply plate 16, and conveys the uppermost one toward the supply guide unit 18.

In FIGS. 4 and 5, the supply guide unit 18 is constituted by five guide plates 22–26 disposed erectly inside the supply frame 15. Top end faces of the guide plates 22–26 are guide faces 22*a*–26*a*, which contact the recording sheet 13 to guide it. The guide plates 22–26 include the central guide plate 22, the intermediate guide plates 23 and 24 and the peripheral guide plates 25 and 26. The central guide plate 22 lies on an extension of a central line of the supply plate 16. The intermediate guide plate 23 lies between the central guide plate 22 and the peripheral guide plate 25. The intermediate guide plate 24 lies between the central guide plate 22 and the peripheral guide plate 26.

In FIG. 6, a stopper block 30 is secured to the central guide plate 22. The stopper block 30 is disposed in a position to receive a margin line of the recording sheet 13 from the supply plate 16. The stopper block 30 is made of rubber material and formed in a generally rectangular shape. A top end 30*b* of the stopper block 30 is protruded over the guide face 22*a* of the central guide plate 22 to orient a regulating face 30*a* in a crosswise inclined manner to the guide face 22*a*. The stopper block 30 is inserted in a cutout 22*b* formed in the central guide plate 22. In FIG. 4, a support bracket 31 keeps the stopper block 30 from dropping out of the cutout 22*b*. In the present embodiment, the regulating face 30*a* is formed on the stopper block 30 with an inclined shape. Alternatively the stopper block 30 may have an entirely rectangular shape and may be positioned on the central guide plate 22 in such a manner that its top face may be oriented with an inclination with reference to the guide face 22*a*.

Figure 8:
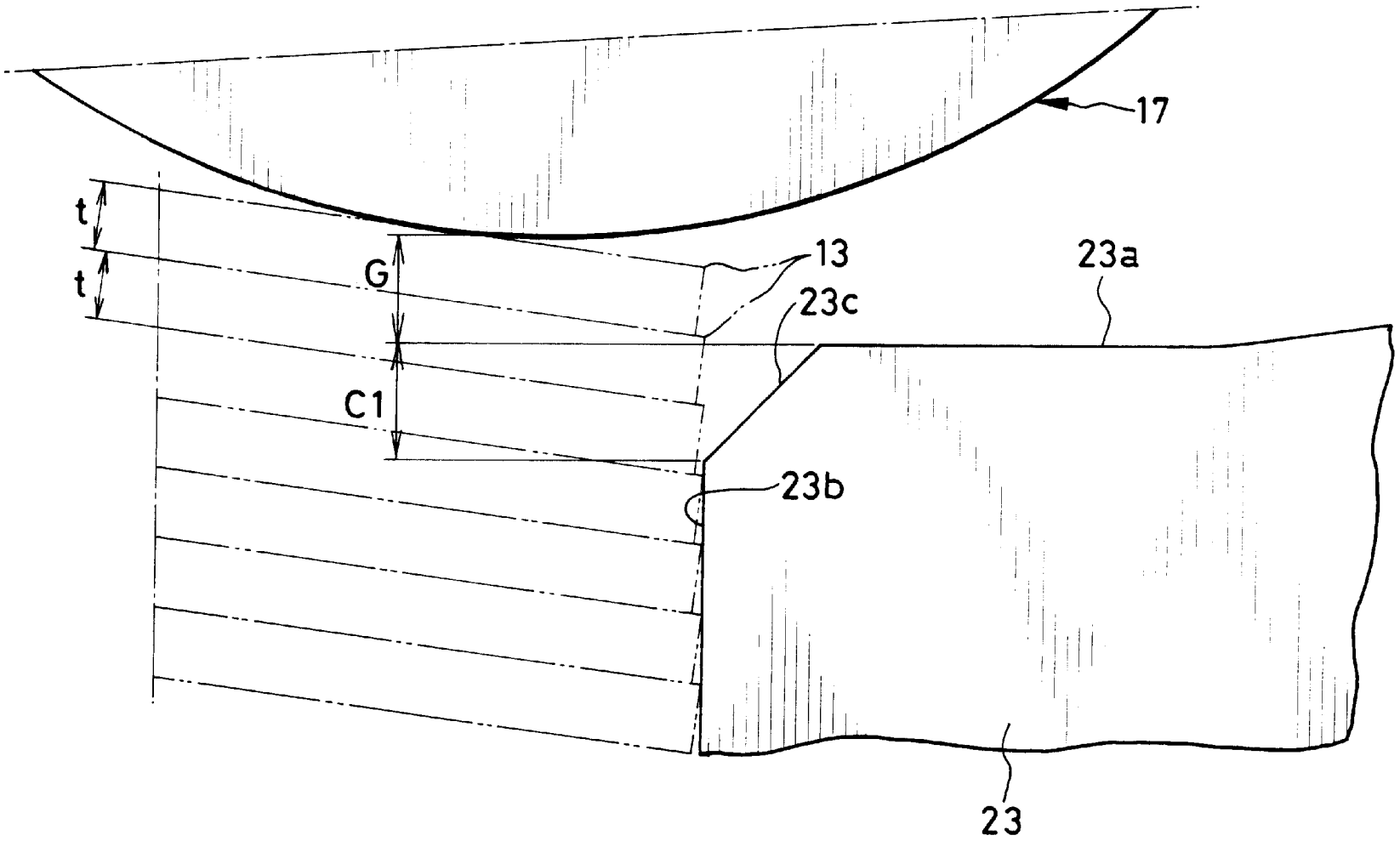
FIG. 8 is an explanatory view in section taken on line VIII—VIII of FIG. 4, illustrating a supply roller and a guide mechanism.

In FIG. 4, the intermediate guide plates 23 and 24 are disposed respectively under the rubber rolls 17*b* and 17*c* of the supply roller 17. In FIG. 8, let G be an interval between the guide face 23*a* of the intermediate guide plate 23 and the supply roller 17. Let t be a thickness of the recording sheet 13. The interval G is determined as:

$$t \leqq G < 2t$$

namely one or more time as much as the thickness of the recording sheet 13, and under two times as much as the thickness of the recording sheet 13. An end face 23*b* of the intermediate guide plate 23 nearer to the supply plate hinders a second uppermost one of the recording sheets 13, and enables only the uppermost one of them to advance. This avoids occurrence of overlapped advancement of recording sheets. In the present embodiment, a corner 23*c* disposed between the guide face 23*a* and the end face 23*b* is faceted at an angle of 45 degrees. An amount C1 of the faceting is 1.5 times as much as the thickness t of the recording sheet 13 (C1=1.5t). Therefore the recording sheet 13 can be transferred from the supply plate to the intermediate guide plate 23. Note that this faceted shape may be omitted. The faceting amount C1 may be suitably changed, and set over or under 1.5t.

The peripheral guide plates 25 and 26 respectively have the guide faces 25*a* and 26*a* in the same shape as that of the central guide plate 22. Unlike the central guide plate 22, the stopper block 30 does not exist on either of the peripheral guide plates 25 and 26. The peripheral guide plates 25 and 26 do not have the cutout 22*b* or the support bracket 31. The central guide plate 22 and the peripheral guide plates 25 and 26 have a smoothly curved face being rounded off for smoothing movement of the recording sheet 13 from the supply plate 16 to them. The central guide plate 22 and the peripheral guide plates 25 and 26 do not have the structure of $t \leqq G < 2t$ as depicted in FIG. 8. In FIG. 4, the end of the supply plate 16 has cutouts 16*c* for receiving insertion of the guide plates 22–26, so that the smoothness in the movement of the recording sheet 13 from the supply plate 16 is increased.

Figure 9:
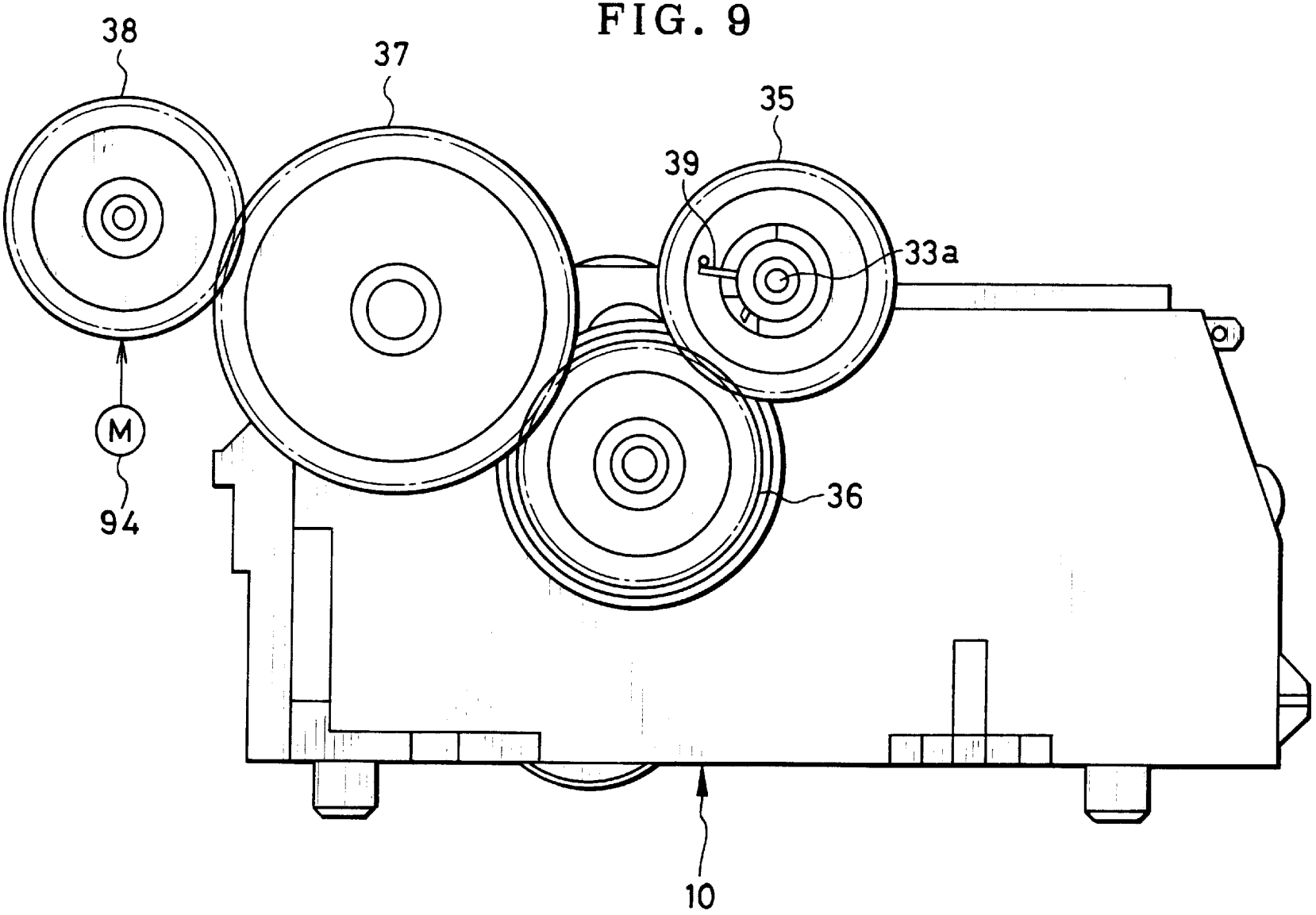
FIG. 9 is a left side elevation illustrating the supply unit.

In FIG. 6, the ejector 19 is constituted by an ejector roller 33 and a path selector mechanism 34. The ejector roller 33 is disposed beside, and higher than, the supply roller 17. In FIGS. 4 and 9, a drive gear 35 is located on an ejector roller shaft 33*a*. The drive gear 35 is associated with a drive gear 38 of the print unit 11 by engagement via intermediate gears 36 and 37. The drive gear 35 is frictionally coupled with the ejector roller shaft 33*a* by a coil spring 39. When load over a predetermined amount is applied to the ejector roller 33, the drive gear 35 rotates about the ejector roller shaft 33*a*.

Figure 10:
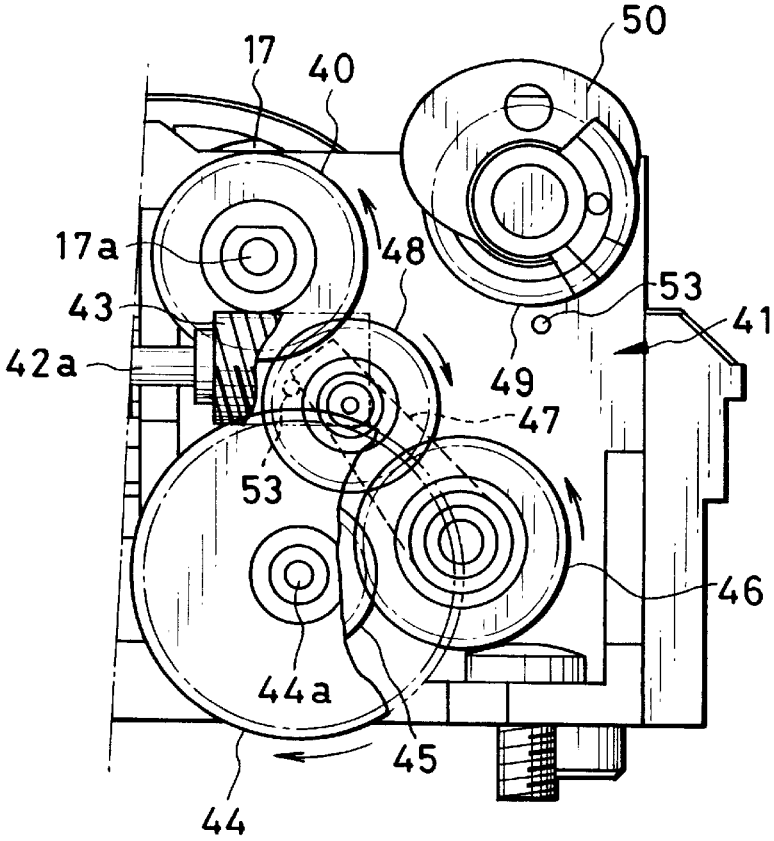
FIG. 10 is a side elevation illustrating a clutch of the supply unit.
Figure 11:
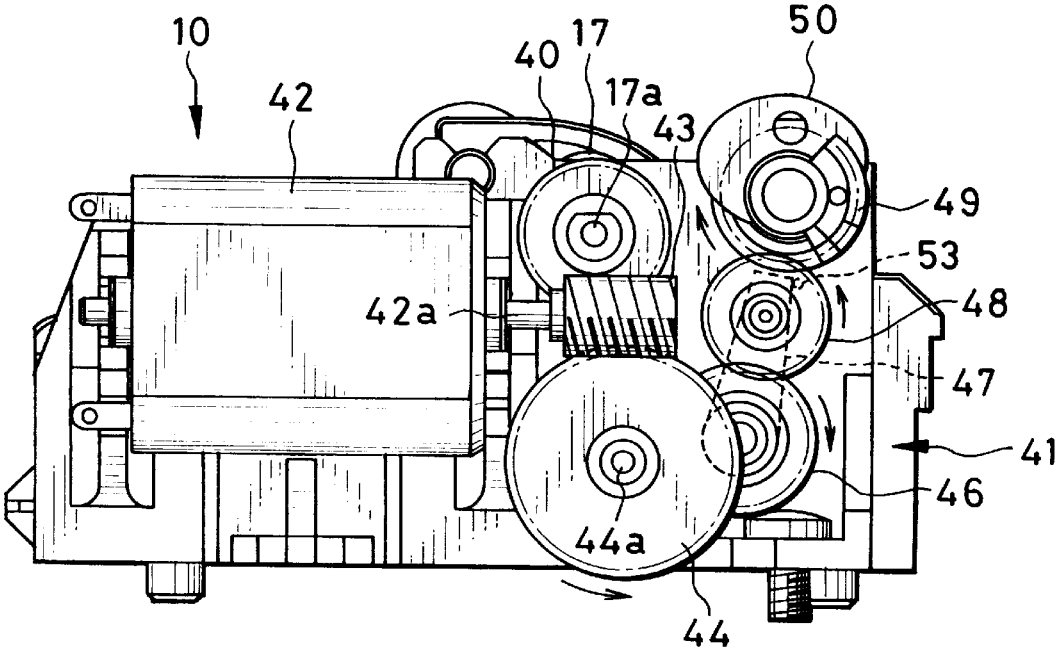
FIG. 11 is a right side elevation illustrating a state where a motor rotates a platen lifter cam.

In FIGS. 10 and 11, a gear 40 is secured to an axial end of the roller shaft 17*a* of the supply roller 17. A drive shaft 42*a* of a supply motor 42 is coupled with the gear 40 via a planetary clutch 41 or planetary gear mechanism. A worm 43 is fixedly coupled with the drive shaft 42*a* of the supply motor 42. A worm wheel 44 is meshed with the worm 43. An intermediate gear 45 is secured on a worm wheel shaft 44*a*. A sun gear 46 of the planetary clutch 41 is meshed with the intermediate gear 45.

The planetary clutch 41 is constituted by a swing arm 47 and a planet gear 48. The swing arm 47 is coaxial with the sun gear 46. The planet gear 48 is rotatable on the swing arm 47 and meshed with the sun gear 46. The swing arm 47 is coupled with the sun gear 46 in a weakly frictional manner, of which friction causes the swing arm 47 to swing in a rotational direction of the sun gear 46. When the swing arm 47 contacts either one of stoppers 53 after the planet gear 48 is rotated by the sun gear 46 in one of two rotational directions, then the swing arm 47 stops swinging despite further rotation of the sun gear 46, due to the frictional coupling. To be precise, when the sun gear 46 rotates counterclockwise in the supply direction, then the swing arm 47 rotates clockwise to engage the planet gear 48 with the gear 40 to transmit rotation of the supply motor 42 to the supply roller 17, which is rotated in the supply direction. When, in contrast, the sun gear 46 rotates clockwise in reverse to the supply direction, then the swing arm 47 rotates clockwise to engage the planet gear 48 with a drive gear 49 to transmit rotation of the supply motor 42 to a platen lifter cam 50, which is included in a shifter mechanism.

In FIG. 3, a cam follower 85 of a swing frame 68 of the central guide plate 22 is in contact with the platen lifter cam 50. The swing frame 68 is included in the shifter mechanism, and swung up and down by the platen lifter cam 50 to move a platen roller 51 as a platen mechanism, which is described later in detail. The platen roller 51 is shifted between a press position and a retracted position, and when in the press position, causes an array 52*a* of heating elements of a thermal head 52 to press the recording sheet 13 as indicated by the solid lines in FIG. 1. The platen roller 51, when in the retracted position, releases the recording sheet 13 from being pressed on the thermal head 52, as indicated by the phantom lines in FIG. 1.

In FIG. 6, the path selector mechanism 34 is mounted pivotally about the ejector roller shaft 33*a*. A cutout 34*a* is formed in the path selector mechanism 34, and receives each of upper ends of the guide plates 22–26 of the supply guide unit 18. After the supply of the recording sheet 13, in turn the recording sheet 13 is conveyed in a print direction reverse to the supply direction of the arrow B. While the recording sheet 13 is conveyed in the print direction, in FIG. 12, a rear margin region of the recording sheet 13 on the supply guide unit 18 is guided by the path selector mechanism 34 toward the ejector roller 33. The path selector mechanism 34 is biased by a bias bracket 55 to a guiding position for the recording sheet 13. Or the path selector mechanism 34 is kept by the bias bracket 55 in the guiding position in a manner resistant to swinging.

Figure 13:
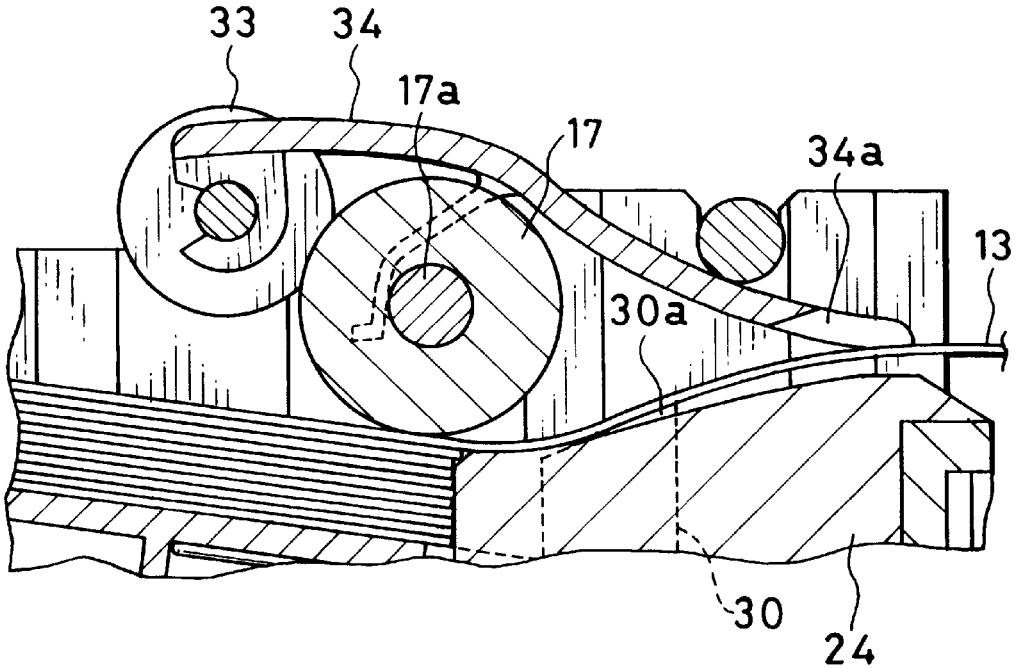
FIG. 13 is an explanatory view in section, illustrating a state of supply of the recording sheet.

An end of the bias bracket 55 is retained on the roller shaft 17*a*. In the course of the sheet supply, a portion of a margin region of the recording sheet 13 pushes open the path selector mechanism 34 upwards, so that the recording sheet 13 can advance to the print unit 11. See FIG. 13. Note that the path selector mechanism 34 may be biased not by the bias bracket 55 but by a coil spring. Furthermore gravity may keep the path selector mechanism 34 in the guiding position without the use of the bias bracket 55.

Figure 12:
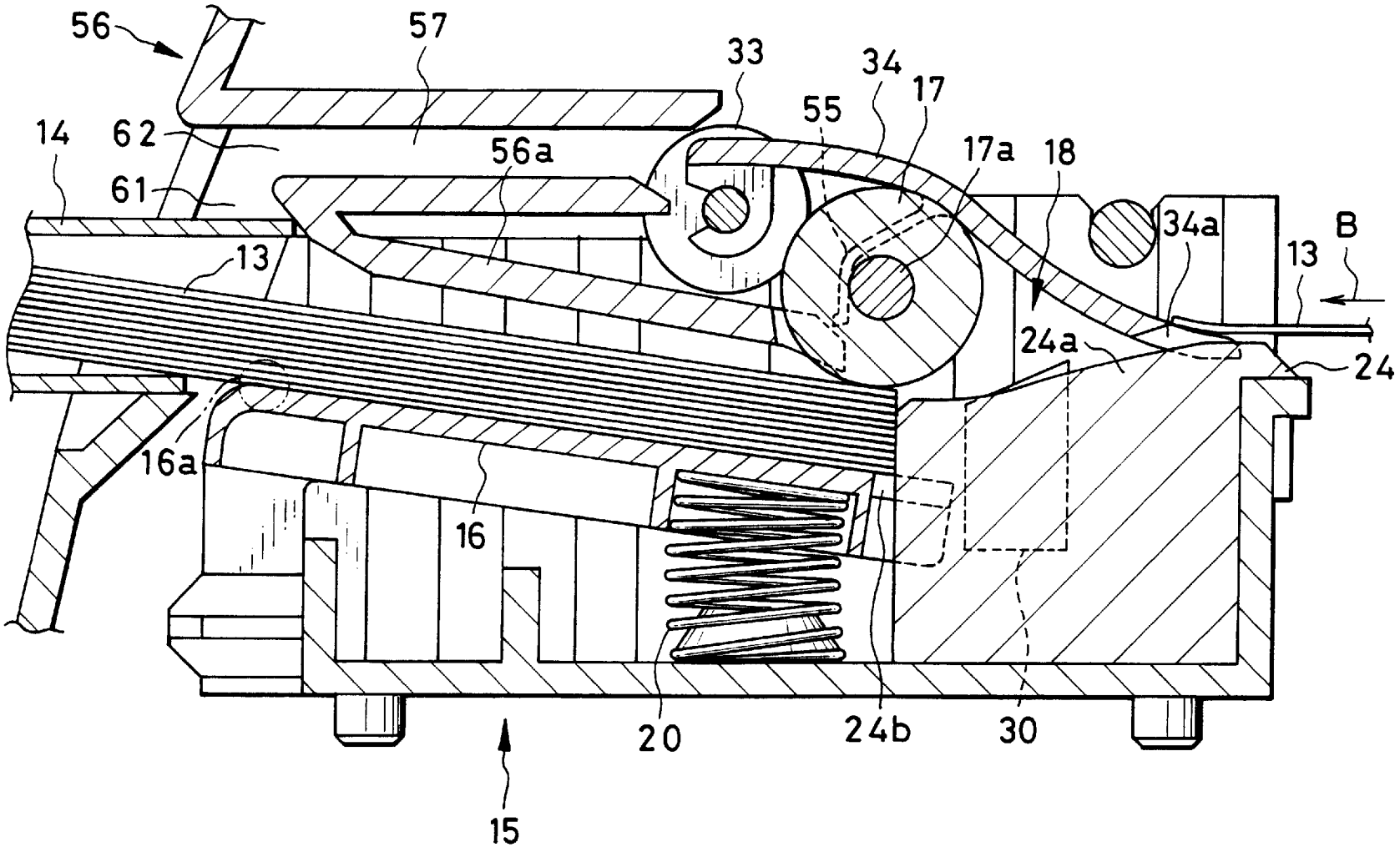
FIG. 12 is a cross section taken on line XII—XII of FIG. 4, illustrating a state of incorporating a sheet supply cassette.

In FIG. 12, the supply frame 15 has an ejector guide unit 56 secured to an exit side of the ejector roller 33 and located over the supply plate 16. The ejector guide unit 56 defines an ejection passageway 57 included in the conveying path. A bottom plate 56*a* of the ejection passageway 57 operates as an upper guide wall at the time of manual insertion of a recording sheet.

If a great number of recording sheets 13 are used in the automated supply, the supply cassette 14 is inserted and set in an entrance opening 61. The supply cassette 14 has a shape of a rectangular tube, and can contain 20 recording sheets at most. Of course the supply cassette 14 may be shaped in a different size. The supply cassette 14 contains the recording sheets 13 in a light-tight manner for the purpose of keeping them from application of ultraviolet rays which would lower their coloring ability. A cap (not shown) is secured to the supply cassette 14, and when the supply cassette 14 is removed from the supply unit 10, keeps the recording sheets 13 from ambient light.

Figure 14:
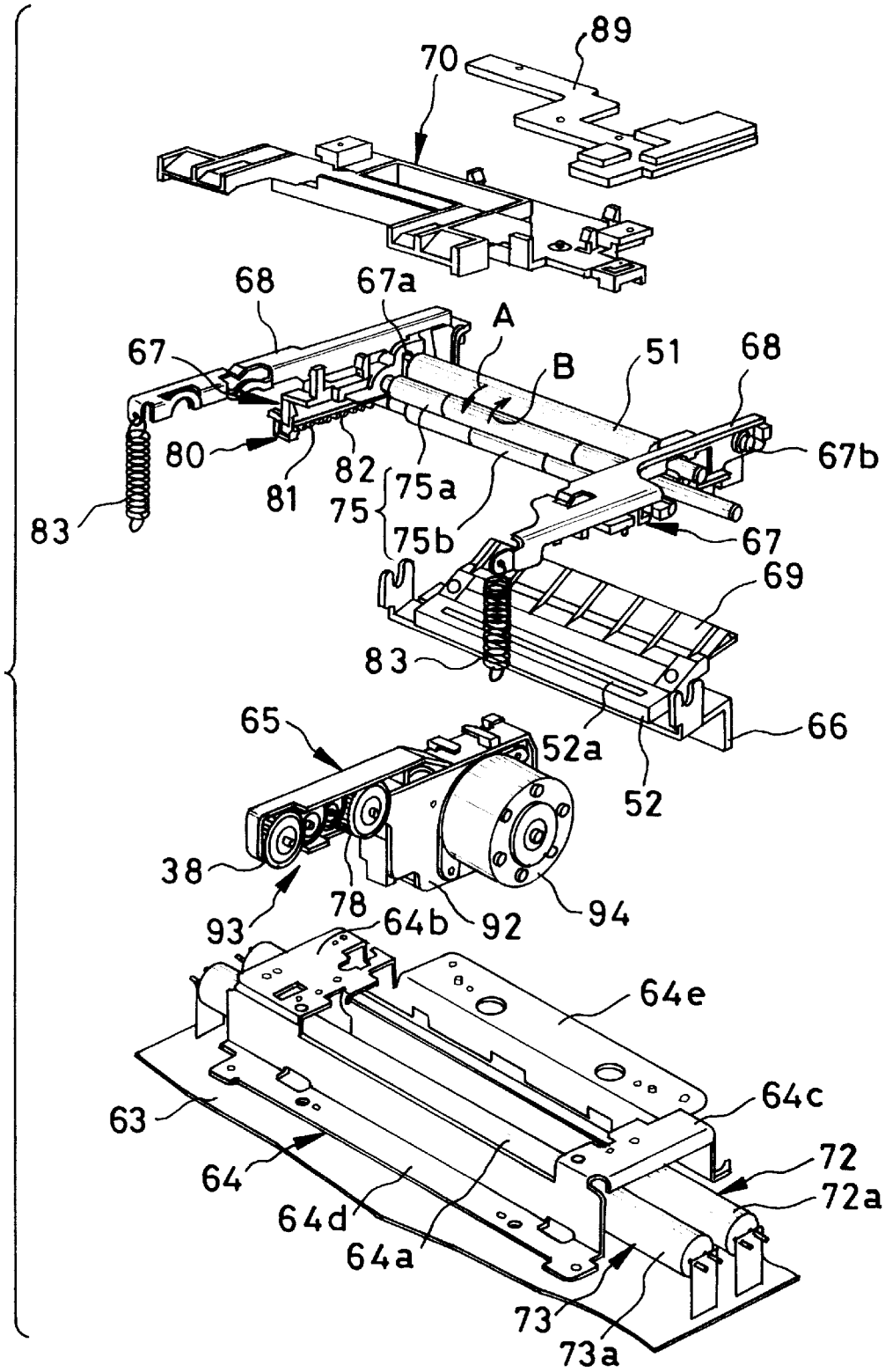
FIG. 14 is an exploded perspective illustrating a print unit.

In FIG. 14, the print unit 11 is generally constituted by a printed circuit board 63, a chassis 64, a drive unit 65, a head support plate 66, a conveyor frame 67 or print passageway, the swing frame 68, a head cover 69 and a sheet guide unit 70. The conveyor frame 67 is included in the conveying path.

In FIG. 1, the printer body 12 has a box shape with a small height. An operation panel 71 is disposed on a top face of the printer body 12. The operation panel 71 includes a display window and a keyboard as an input unit.

The printed circuit board 63 is mounted on the bottom of the inside of the printer body 12. The printed circuit board 63 includes circuits for control of relevant components in the thermal printer 9, and has IC, transistors, resistors, capacitors and other various electrical parts. Yellow and magenta fixer lamps 72 and 73 are disposed on the printed circuit board 63. To cover the fixer lamps 72 and 73 on the printed circuit board 63, the chassis 64 is secured.

The yellow fixer lamp 72 emanates visible violet rays or near ultraviolet rays in a wavelength range peaking at the wavelength of 420 nm, and fixes the yellow coloring layer 13*e* of the recording sheet 13, in order to avoid further coloring of the yellow coloring component in the course of the magenta recording. The magenta fixer lamp 73 emanates ultraviolet rays in a wavelength range peaking at the wavelength of 365 nm, and fixes the magenta coloring layer 13*f*, in order to avoid further coloring of the magenta coloring component in the course of the cyan recording. In FIG. 14, the fixer lamps 72 and 73 have a substantially straight tubular shape, and emanate rays at such distribution that amounts of rays are constant in central portions between ends 72*a* and 73*a*, but not constant in the ends 72*a* and 73*a*. The central portions are used for fixing the recording sheet 13. Note that, if lengths of the ends 72*a* and 73*a* were greater, the fixer lamps 72 and 73 would have an excessive length to increase a width of the printer body 12. This would be inconsistent to an advantageous reduction in the size of the printer body 12. It is however preferable that the fixer lamps 72 and 73 with a great length are shaped in a bent form like a letter L, in which the ends 72*a* and 73*a* are bent vertically. Consequently it is possible to keep the printer width small while the length of the central portions of the fixer lamps 72 and 73 are increased.

The chassis 64 is formed by bending a single flat metal plate in a channel shape. A ray applying opening 64*a* is formed in the chassis 64 for passage of rays from the fixer lamps 72 and 73. The chassis 64 includes support brackets 64*b* and 64*c* located beside the ray applying opening 64*a*. Also the chassis 64 includes support brackets 64*d* and 64*e*, which are respectively located on the supply side and the downstream side.

A set of feeder rollers 75 in a conveyor unit and the platen roller 51 are respectively rotatable on the conveyor frame 67. The feeder roller set 75 is constituted by a capstan roller 75*a* and a nip roller 75*b*. A gear (not shown) is fixed on an axial end of the capstan roller 75*a*, and is in mesh with a roller drive gear 78 of the drive unit 65, which causes the capstan roller 75*a* to rotate in the supply direction of the arrow A, and in the print direction of the arrow B reverse to the supply direction. Note that the supply direction is herein referred to as a first direction A, the print direction being referred to as a second direction B.

Figure 15:
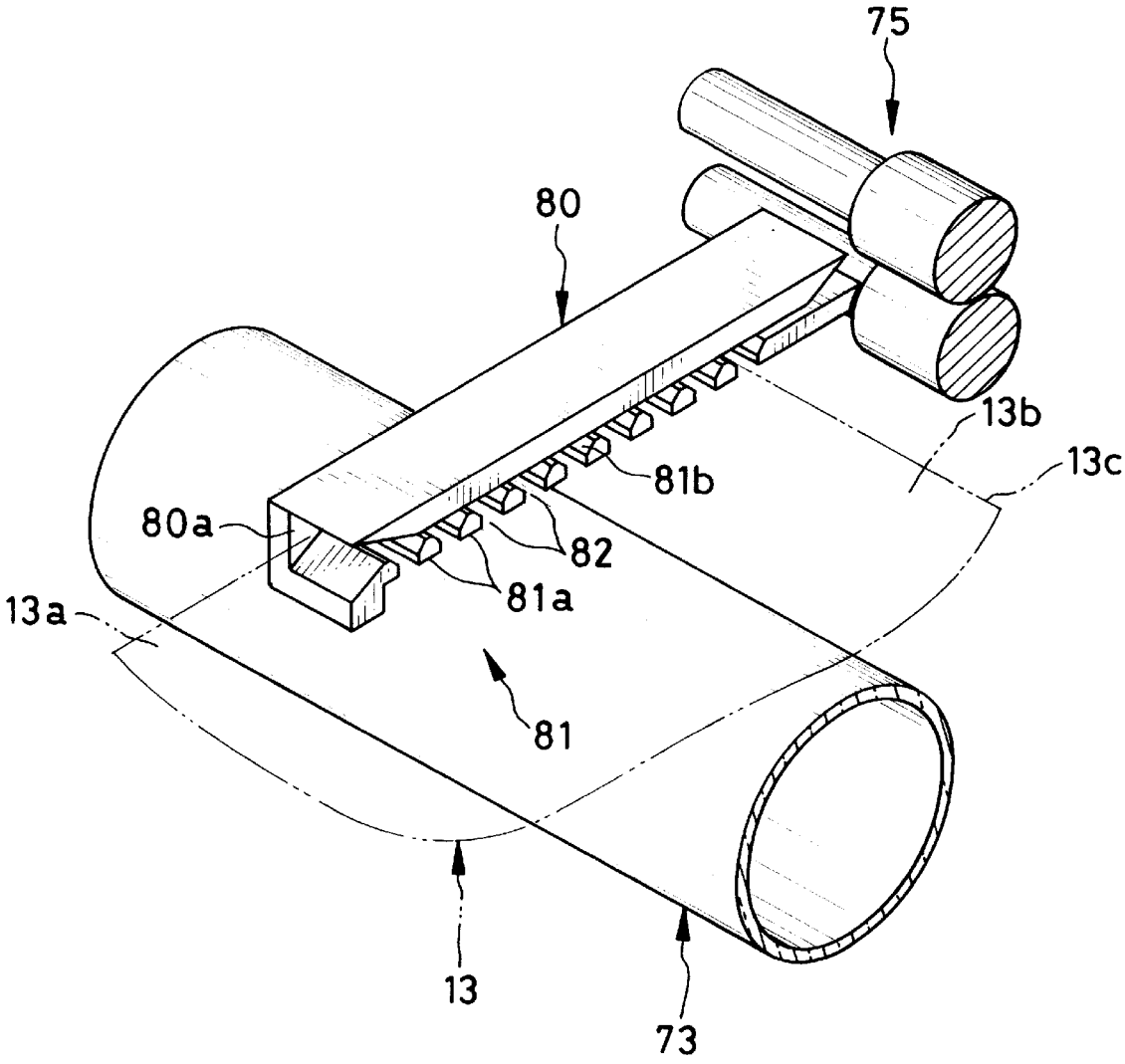
FIG. 15 is an explanatory view in perspective, illustrating a rail unit having rail tooth portions.
Figure 16:
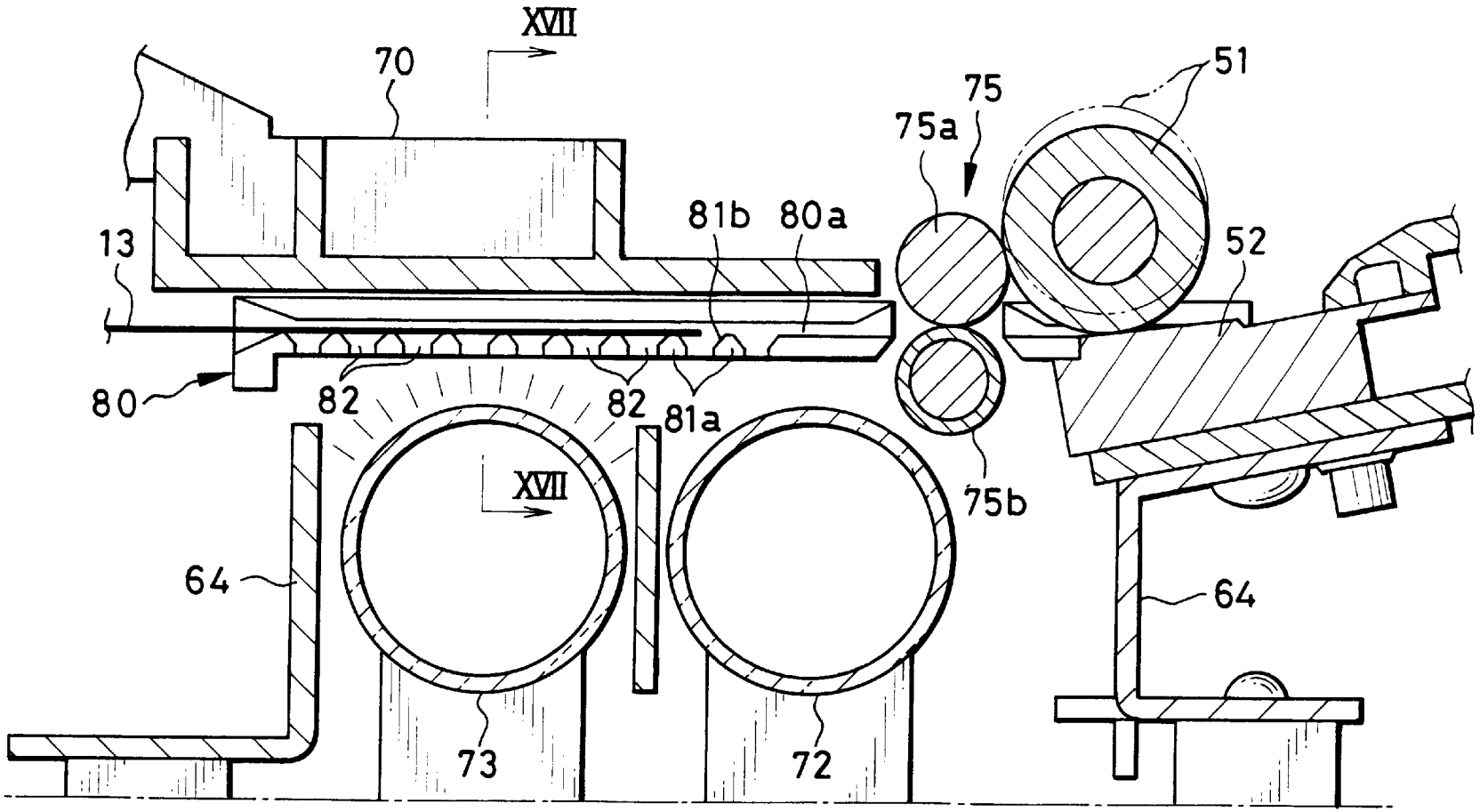
FIG. 16 is a cross section illustrating a stopped state for bleaching a rear margin.
Figure 17:
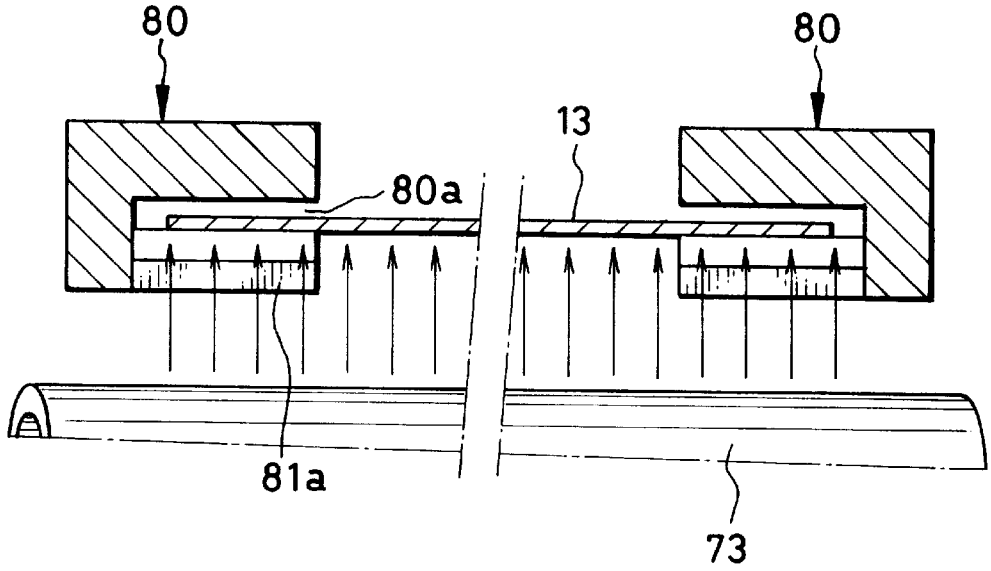
FIG. 17 is an explanatory view in section taken on line XVII—XVII of FIG. 16, illustrating the rail unit with a fixer.

A rail unit or a pair of paper guides 80 are secured to the conveyor frame 67 and located on the supply side of the feeder roller set 75. The paper guides 80 support lateral sides 13*a* of the recording sheet 13 defined in its length direction, and guides the recording sheet 13 toward the feeder roller set 75. In FIG. 15, the paper guides 80 as viewed in cross section have a channel shape inside which a guide channel 80*a* is formed. A rail tooth portion or a rail bottom 81 of the paper guides 80 is formed in a comb shape, and includes a plurality of ray applying gaps 82 arranged at one pitch. In FIGS. 16 and 17, the lateral sides 13*a* of the recording sheet 13 guided by the paper guides 80 are optically fixed and bleached through the ray applying gaps 82. The lateral sides 13*a* do not remain unbleached in belt shapes. In FIG. 16, rail teeth 81*a* of the rail bottom 81 include facets 81*b* which are defined by cutting upper corners of a rectangular shape. The facets 81*b* enable the recording sheet 13 to receive a sufficient amount of rays from the magenta fixer lamp 73.

Among portions of the paper guides 80, at least the rail bottom 81 is formed from transparent material, for the purpose of increasing an effect of rays applied to the lateral sides 13*a*.

In FIG. 14, the platen roller 51 is supported in a manner movable up and down by means of a slot 67*a* formed in the conveyor frame 67. An axial end of the platen roller 51 is rotatable on the swing frame 68. One end of the swing frame 68 is secured to an end of the conveyor frame 67 by use of a support shaft 67*b* in a pivotal manner. A coil spring 83 is secured to another end of the swing frame 68, and biases the swing frame 68 down. In FIG. 2, another end of the coil spring 83 is secured to a spring receiving bracket 84, which extends from the supply frame 15 of the supply unit 10. In FIG. 3, the cam follower 85 is formed with the swing frame 68 to project downwards and in a flexed shape, and is contacted by the platen lifter cam 50.

In FIGS. 1 and 14, the thermal head 52 is secured to the chassis 64 by means of the head support plate 66 in a position of contact with the platen roller 51. The head support plate 66 has heat dissipator fins 86 for dissipating heat generated from the thermal head 52. The head cover 69 is associated with the thermal head 52, and guides the recording sheet 13. The sheet guide unit 70 is located above the fixer lamps 72 and 73, and is secured to the conveyor frame 67 in a removable manner. A sensor base plate 89 is mounted on the sheet guide unit 70. On the sensor base plate 89 are disposed a lamp irradiance sensor, a rear margin detecting sensor for the recording sheet, and a sensor for detecting rotations of the capstan roller.

The drive unit 65 is constituted by a gear train 93, a conveyor motor 94, and a drive frame 92 incorporating the coil spring 83 and the conveyor motor 94. The gear train 93 includes the roller drive gear 78 and the drive gear 38. The roller drive gear 78 is meshed with the gear of the capstan roller 75*a* and rotates it. The drive gear 38 is meshed with the intermediate gear 37 for rotating the ejector roller 33. See FIG. 9. The gear train 93 transmits rotation of the conveyor motor 94 to the capstan roller 75*a* and the ejector roller 33 in such a manner that peripheral speed of the capstan roller 75*a* and the ejector roller 33 is kept constant, so that the capstan roller 75*a* and the ejector roller 33 are rotated in the first direction A for the supply and in the second direction B for the printing. See FIGS. 1 and 14.

The swing frame 68 and the platen lifter cam 50 constitute a lifter mechanism 97. See FIG. 18. The lifter mechanism 97 shifts the platen roller 51 between the press position and the retracted position. In the press position, the recording sheet 13 is pressed by the heating element array 52*a* of the thermal head 52. The heating element array 52*a* includes a great number of heating elements arranged in a direction parallel with an axis of the platen roller 51. For the thermal printing, each heating element is driven according to image data, to record a full-color image to the recording sheet 13 in the three-color frame sequential method.

Figure 18:
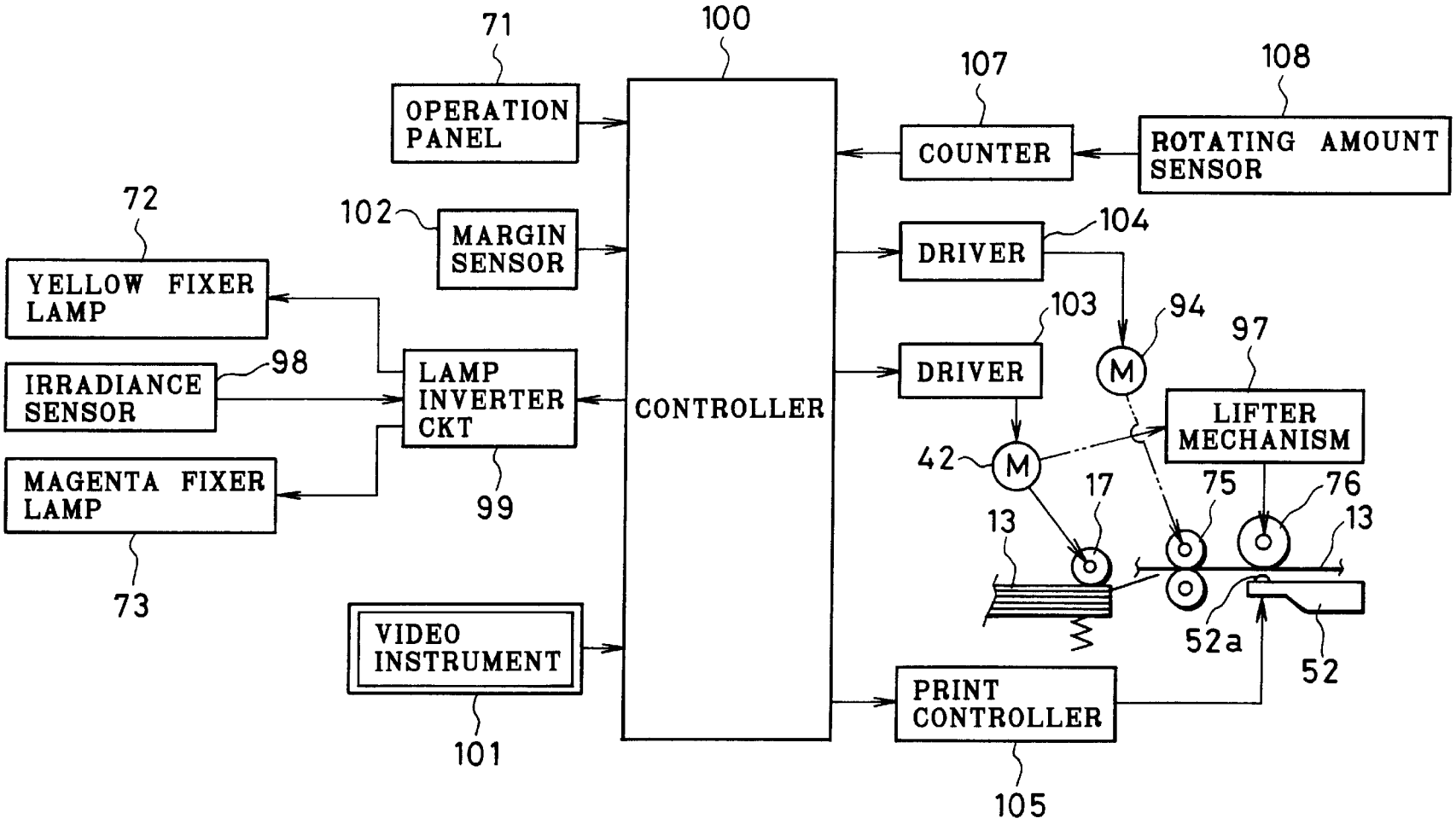
FIG. 18 is a block diagram schematically illustrating circuits of the thermal printer.

The fixer lamps 72 and 73 are disposed near to each other, for the purpose of making them arranged in a compact space. In FIG. 18, an irradiance sensor 98 is disposed between the fixer lamps 72 and 73, and measures their irradiance. A signal from the irradiance sensor 98 is sent to a lamp inverter circuit 99, which adjusts voltage applied to the fixer lamps 72 and 73 to keep the irradiance unchanged.

In FIG. 18, electrical circuits of the thermal printer 9 are depicted. A controller 100 consists of a microcomputer well-known in the art, and receives image data from a video instrument 101 or any of a digital still camera, a video recorder, a television set, a personal computer, and the like.

After a print start signal is generated by operation of the operation panel 71 and after a detection signal is generated by a margin sensor 102, the controller 100 operates for printing a full-color image on to the recording sheet 13 by controlling drivers 103 and 104, the lifter mechanism 97, a print controller 105, the lamp inverter circuit 99 and a counter 107.

The controller 100 causes the driver 103 to rotate the supply motor 42 in the forward or backward direction. In the forward rotation, the planet gear 48 of the planetary clutch 41 is in mesh with the gear 40 to rotate the supply roller 17 in the supply direction. In the backward rotation, the planet gear 48 comes in mesh with the drive gear 49, to set the platen lifter cam 50 in the platen press position or platen retreat position.

The controller 100 causes the driver 104 to rotate the conveyor motor 94 in a forward or backward direction. In the forward rotation, the capstan roller 75*a* is rotated in the first direction A to convey the recording sheet 13 in a supply direction. In the backward rotation, the capstan roller 75*a* is rotated in the second direction B to convey the recording sheet 13 in a print direction. While the recording sheet 13 is conveyed by the conveyor motor 94, the controller 100 causes the counter 107 to count pulses from a rotating amount sensor 108 which detects a rotating amount of the roller. This counting operation is started upon occurrence of a rear margin detecting signal generated by the margin sensor 102. The pulses are counted up when the recording sheet 13 is conveyed in the print direction, and counted down when the recording sheet 13 is conveyed in the supply direction. It is possible to detect a relationship between positions of the recording sheet 13 and the heating element array 52*a* of the thermal head 52 during the conveyance, and to determine various positions, including a conveyance stop position, a conveyance start position, a press start position of the recording sheet relative to the heating element array, a press release position of the recording sheet relative to the heating element array, a print start position, and a print finish position. The margin sensor 102 is disposed between the intermediate gears 36 and 37 and near to the intermediate gear 37, and detects passage of the first or rear margin line and the second or front margin line of the recording sheet 13.

Of course the rotating amount sensor 108 generates one pulse each time that the capstan roller 75*a* rotates by a unit rotating amount.

The print controller 105 is constituted by a head driver and a memory, which stores three-color image data of one frame. The print controller 105 drives each of the heating elements of the heating element array 52*a* in accordance with image data of the respective three colors. The heating elements develop heat associated with the respective colors and image data of the colors, to color the recording sheet 13 at desired density. The lamp inverter circuit 99 controls the fixer lamps 72 and 73 at a constantly regulated amount of rays in accordance with a detection signal from the irradiance sensor 98. Note that the memory does not require capacity enough to store data of one frame. The memory may have only small capacity enough to store data of a number of lines within one frame. For such a memory, image data is consecutively sent to the thermal printer 9 by the video instrument 101 by a unit amount of several lines and in accordance with the sequential steps for the printing.

Figure 19A:
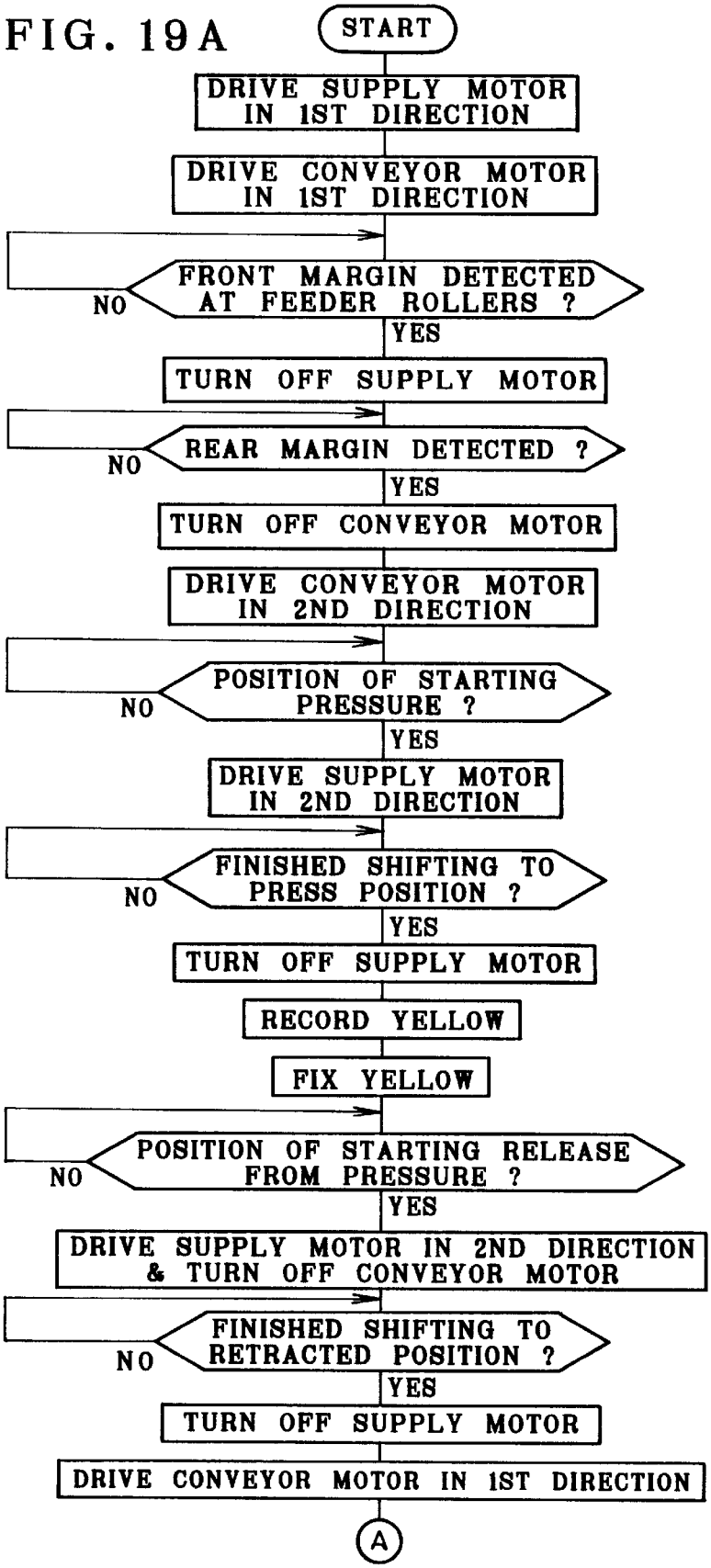
FIGS. 19A and 19B are a flow chart illustrating operation of the thermal printer.
Figure 19B:
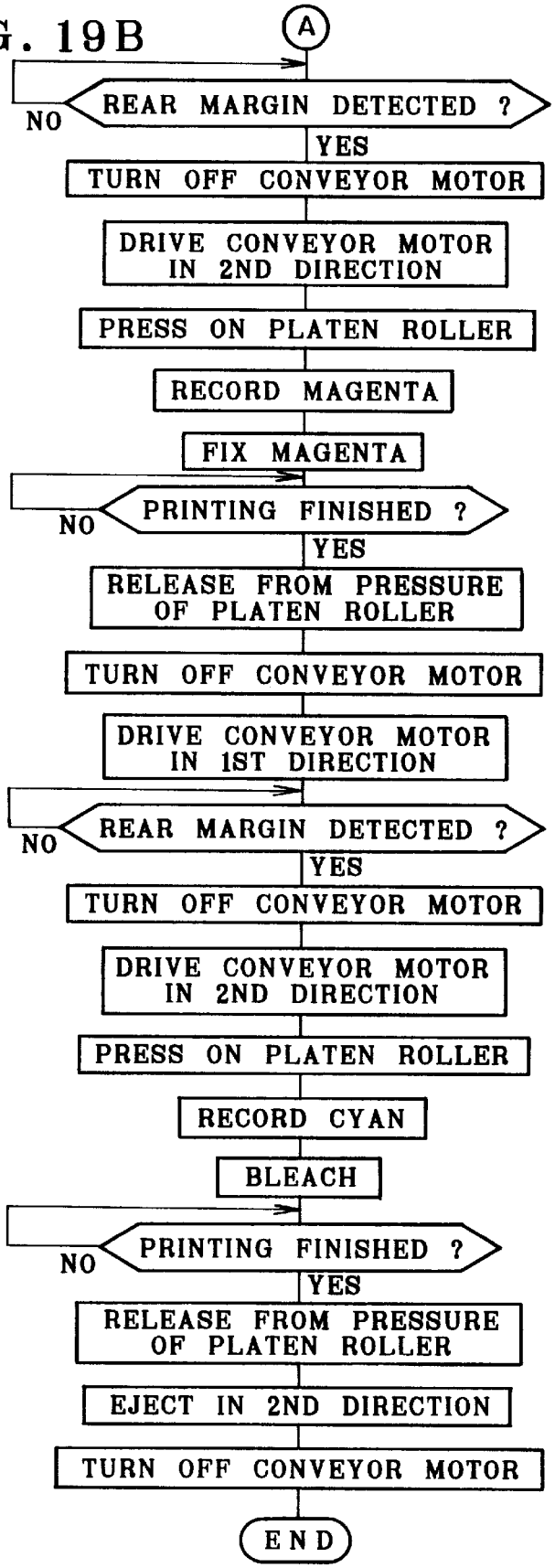
Figure 20:
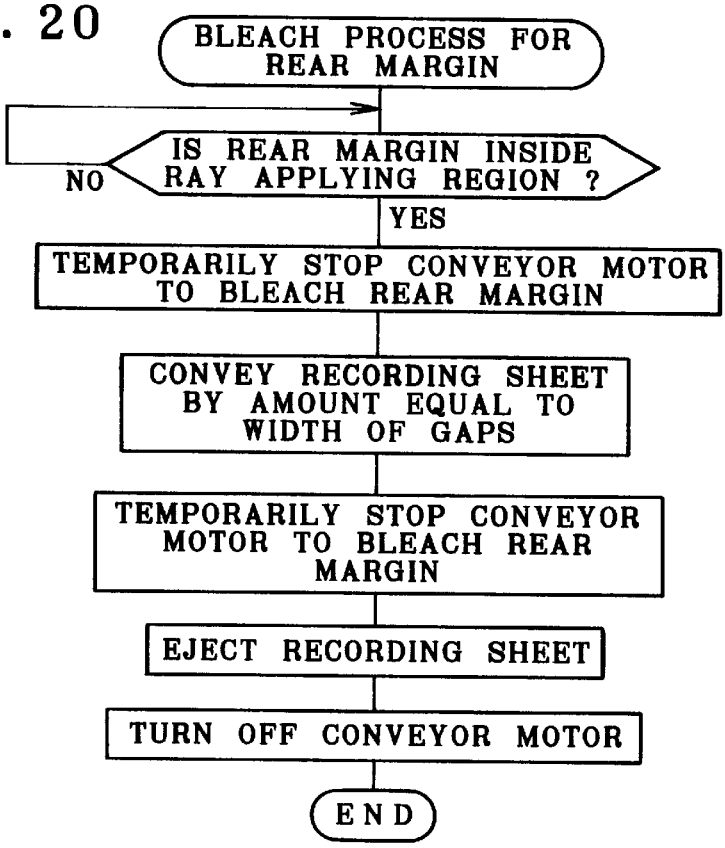
FIG. 20 is a flow chart illustrating a bleaching process for the rear margin.

The operation of the above construction is described with reference to FIGS. 19A, 19B and 20. A user manually operates the operation panel 71 to enter a command of printing. Responsively the supply motor 42 and the conveyor motor 94 are caused to rotate in the supply direction. If the recording sheet 13 does not exist on the supply plate 16, a message for instructing a recording sheet to be supplied is indicated in a display window of the operation panel 71. If the recording sheet 13 is not automatically inserted, the recording sheet 13 is manually set on the supply plate 16 and inserted between it and the supply roller 17. Then the recording sheet 13 is sent to the printer body 12 by rotation of the supply roller 17.

When the second or front margin line of the recording sheet 13 is moved past the feeder roller set 75, the supply motor 42 is stopped. For detection of the passage of the second or front margin line at the feeder roller set 75, at first the second or front margin line being moved is detected by the margin sensor 102. Upon this detection, elapsed time starts being measured. The measured elapsed time is evaluated. When the measured elapsed time becomes a predetermined value, the passage of the second or front margin line at the feeder roller set 75 is recognized. It is to be noted that an additional sensor may be disposed near to the feeder roller set 75 for directly detecting the second or front margin line. Afterwards the feeder roller set 75 conveys the recording sheet 13 in the supply direction. When the first or rear margin line is conveyed past the margin sensor 102, the conveyor motor 94 is stopped, to stop the sheet supply.

The conveyor motor 94 is caused to rotate in the print direction to effect the printing operation. According to the counted number of the counter 107, the controller 100 determines the press start position of the thermal head 52, the print start position, the print finish position, the retreat start position of the thermal head 52, and the conveyance stop position of the recording sheet 13. At first the press start position is determined. In FIG. 11, the supply motor 42 is rotated in reverse to the supply direction. This reverse rotation brings the planet gear 48 of the planetary clutch 41 in mesh with the drive gear 49, so that the platen lifter cam 50 is rotated. The platen lifter cam 50 is rotationally shifted from the lifting position to the lowering position. The swing frame 68 is lowered to set the platen roller 51 in the press position. The planetary clutch 41 is stopped when the platen roller 51 comes to the press position.

When a front edge or start position of a recording region of the recording sheet 13 comes to the heating element array 52*a* of the thermal head 52, the yellow color starts being thermally recorded. In the yellow recording, the yellow fixer lamp 72 is kept turned on to fix the yellow coloring layer 13*e*, which will be prevented from developing further color in the course of the magenta or cyan recording. Upon the finish of the yellow recording, the platen roller 51 comes to the press release position. Then the supply motor 42 rotates in the direction reverse to the supply direction, so that the platen lifter cam 50 makes half a rotation. The platen roller 51 is set in the retreat position. The conveyor motor 94 is stopped from rotating in the print direction. After this, the conveyor motor 94 is rotated in the supply direction to return the recording sheet 13 to the print start position.

The magenta and cyan colors are similarly printed in the three-color frame-sequential method of thermal recording, to obtain a full-color image. The magenta fixer lamp 73 is turned on during the magenta recording, to fix the magenta coloring layer 13*f* optically. Again the magenta fixer lamp 73 is turned on during the cyan recording, to bleach unrecorded portions of the recording sheet, which would remain with a yellow-greenish color if not bleached. The recording sheet 13 after the finish of the cyan recording is sent to conveyed to an exit 62. See FIG. 1.

When the first or rear margin line of the recording sheet 13 comes to the ray applying region of the magenta fixer lamp 73, the rear margin region of the recording sheet 13 is bleached. See FIG. 20. For the bleaching, it is detected at first whether the first or rear margin line of the recording sheet 13 has come into the ray applying region of the magenta fixer lamp 73 during the ejection of the recording sheet 13. Upon the finish of the cyan recording, an amount of conveying the recording sheet 13 starts being measured. It is checked whether the conveying amount has become an amount, which is predetermined as such an amount by which the recording sheet has been conveyed until the first or rear margin line has normally come to the ray applying region. Upon the reach of the first or rear margin line to the ray applying region of the magenta fixer lamp, the conveyor motor is stopped in a temporary manner. During this stop the magenta fixer lamp 73 emanates rays to bleach the rear margin region of the recording sheet.

Then the recording sheet 13 is conveyed by a length equal to a width of the ray applying gaps 82 as viewed in the conveying direction, before the recording sheet 13 is stopped. This is the intermittent conveyance. Portions of the lateral sides 13*a* of the recording sheet 13 masked by the rail teeth 81*a* during the previous stop of the recording sheet 13 are moved to positions of the ray applying gaps 82, and are bleached in a reliable manner. After the stop, the conveyor motor rotates by a predetermined amount, to eject the recording sheet. Note that the stops for the two times are continued until rays from the fixer lamp come up to an amount enough for the bleaching.

If a user desires to obtain a plurality of printed sheets, the supply cassette 14 is set in the entrance opening 61. See FIG. 12. The supply cassette 14 contains the recording sheets 13 in a light-tight state. The operation of sheet supply is started when the supply motor 42 is rotated in the supply direction. In the supply, the guide faces 23*a* and 24*a* of the intermediate guide plates 23 and 24 and the supply roller 17 are positioned in such a manner that $$t \leqq G < 2t$$

where G is the thickness of the space and t is the thickness of the recording sheet 13. See FIGS. 8 and 12. Recording sheets lower than the uppermost sheet are hindered by the guide faces 23*a* and 24*a* from advancement. It is possible to prevent two or more sheet from being conveyed in an overlapped manner.

Figure 21:
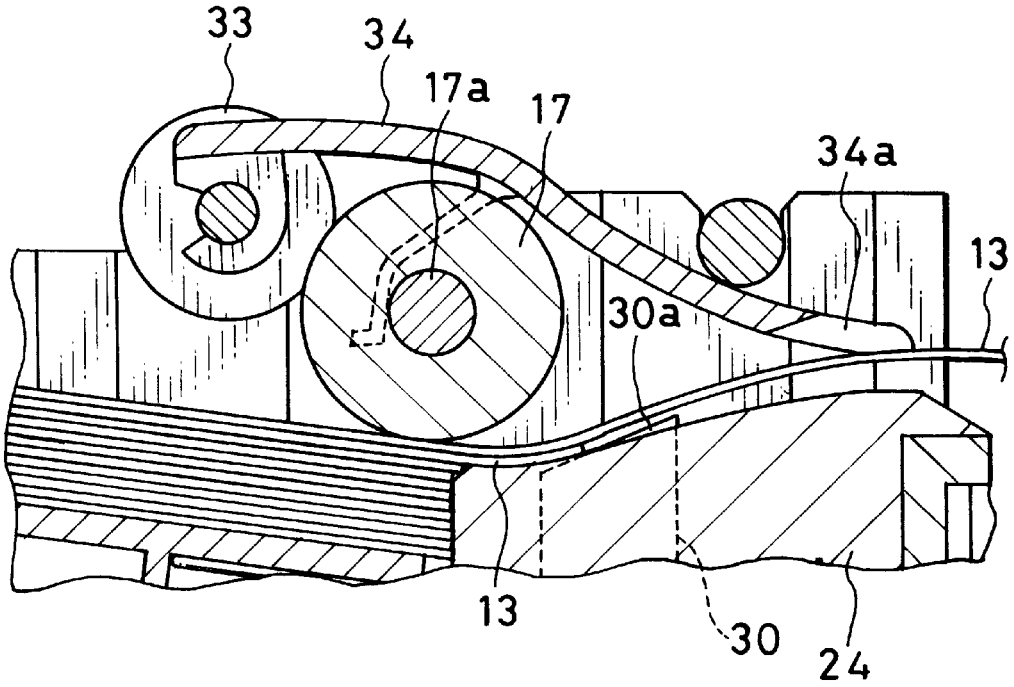
FIG. 21 is an explanatory view in section, illustrating an accidental state where two overlapped sheets are supplied.

It is conventionally likely that two overlapped recording sheets 13 are conveyed to the side of the sheet guide, typically because the recording sheets 13 in use have a smaller thickness than is determined according to the specification of the thermal printer 9. However the second or front margin line of the second uppermost recording sheet is contacted by the regulating face 30*a* of the stopper block 30, and hindered from advancing. See FIG. 21. It is possible to allow only one recording sheet to advance at one time.

Note that positions of the thermal head 52 and the feeder roller set 75 are not limited to the above embodiment, but may be modified as desired. The printing operation is not limited to the above embodiment, but may be modified suitably. For example, the yellow coloring layer 13*e* may be fixed during the conveyance in the supply direction after the yellow recording. Also it is possible to fix the yellow coloring layer 13*e* both during the conveyance in the print direction associated with the yellow recording, and during the conveyance in the supply direction after the yellow recording. In the above embodiment, the platen roller 51 is moved up and down. Alternatively the thermal head 52 may be moved up and down whereas the platen roller 51 may be disposed in a stationary manner.

In the above embodiment, the rotation of the capstan roller 75*a* is detected by the rotating amount sensor 108. Alternatively the position of the recording sheet 13 in the printing unit may be detected differently. For example the conveyor motor 94 may be a stepping motor supplied with drive pulses. The drive pulses may be counted, to recognize the position of the recording sheet 13. In the above embodiment, the supply plate is swung and supports a great number of recording sheets. Alternatively a movable supply plate may be used and may be moved straight in a parallel manner.

Figure 22A:
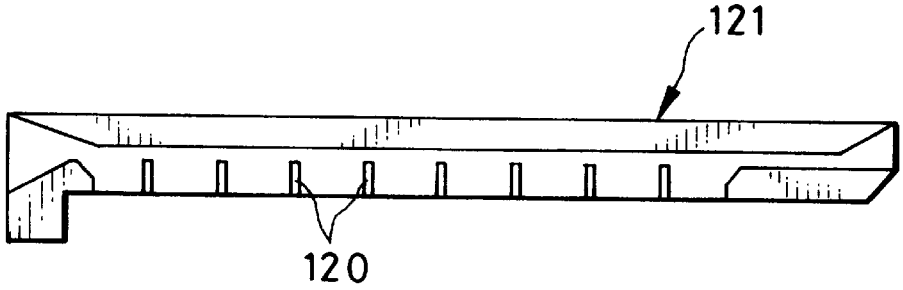
FIG. 22A is a side elevation illustrating another preferred rail unit having rectangular teeth.
Figure 22B:
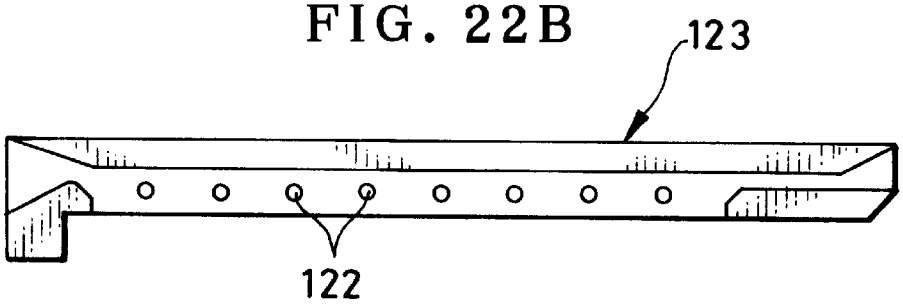
FIG. 22B is a side elevation illustrating still another preferred rail unit having rod-shaped teeth.
Figure 22C:
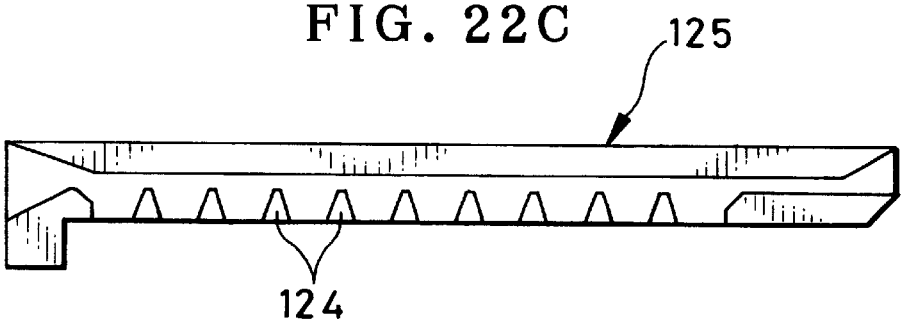
FIG. 22C is a side elevation illustrating another preferred rail unit having teeth in a triangular prism shape.

In the above embodiment, the width of the rail teeth 81*a* of the paper guides 80 is set equal to that of the ray applying gaps 82 with respect to the conveying direction. However the rail teeth 81*a* and the ray applying gaps 82 may have any suitably determined widths. For example the width of the rail teeth 81*a* of the paper guides 80 may be greater than that of the ray applying gaps 82 with respect to the conveying direction. Efficiency in bleaching the lateral sides 13*a* will be increased. Also the shape of the rail teeth 81*a* may be modified suitably. In FIG. 22A, a pair of paper guides or rail unit 121 has rail teeth 120 having a rectangular shape as viewed in cross section, like a thin plate. In FIG. 22B, a pair of paper guides or rail unit 123 has rail teeth 122 having a rod shape or cylindrical shape. In FIG. 22C, a pair of paper guides or rail unit 125 has rail teeth 124 having a shape of a triangular prism.

Figure 23:
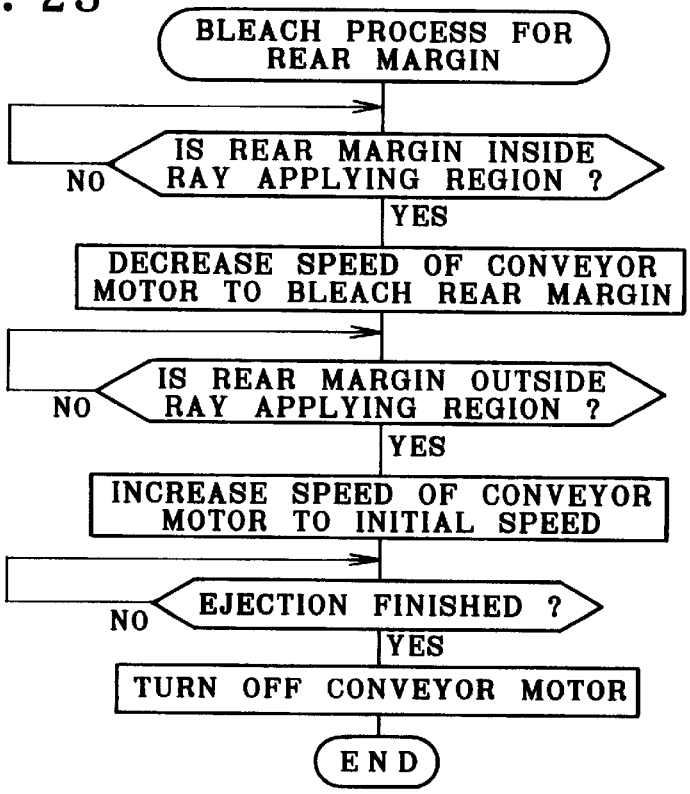
FIG. 23 is a flow chart illustrating another preferred bleaching process for the rear margin.

In the above embodiment, the recording sheet 13 is stopped in a temporary manner to bleach a first or rear margin region 13*b*. FIG. 23 depicts another preferred embodiment, in which the speed of the conveyor motor is decreased when the rear margin region 13*b* comes to the ray applying region of the magenta fixer lamp 73, to bleach the rear margin region 13*b* while the recording sheet 13 is conveyed at the decreased speed. The rear margin region 13*b* and the lateral sides 13*a* are bleached by application of rays at an amount enough to bleach. After a rear margin line 13*c* of FIG. 15 is moved past the ray applying region to finish the bleaching, the speed of the conveyor motor to set again at its initial speed, before the recording sheet 13 is ejected.

Note that the resetting of the speed of the conveyor motor may be omitted, so that the recording sheet 13 may be ejected at the same decreased speed.

In the above embodiment, the support shaft 16*a* of the supply plate 16 is positioned at a level of an upper surface for placing the recording sheet. Alternatively it is possible to dispose the support shaft 16*a* in any suitable position at the rear end of the supply plate 16, namely higher or lower than the upper surface for placing the recording sheet. In the above embodiment, the supply plate 16 is disposed pivotally about the rotational shaft. Alternatively the supply plate 16 may be disposed in a manner shiftable up and down by use of rails or other guiding structures.

Another preferred embodiment is described now by referring to FIGS. 24–30, in which a user can be caused to recognize a finish of the printing operation.

There is a suggestion of a color thermal printer of JP-A (Japanese Patent Laid-open Publication No.) 8-174883, which is characterized by a reduced size of the printer body with a simplified structure of a sheet feeder mechanism. A portion of the recording sheet inevitably appears outside the printer body. While a full-color image is being printed, the user is informed of the printing operation by the apparent movement of the recording sheet. However the recording sheet is stopped in the course of bleaching the margin region. The stopped appearance may cause the user to misunderstand the condition. He may forcibly pull out the recording sheet during the bleaching even when the recording sheet has not finished being treated.

Figure 24:
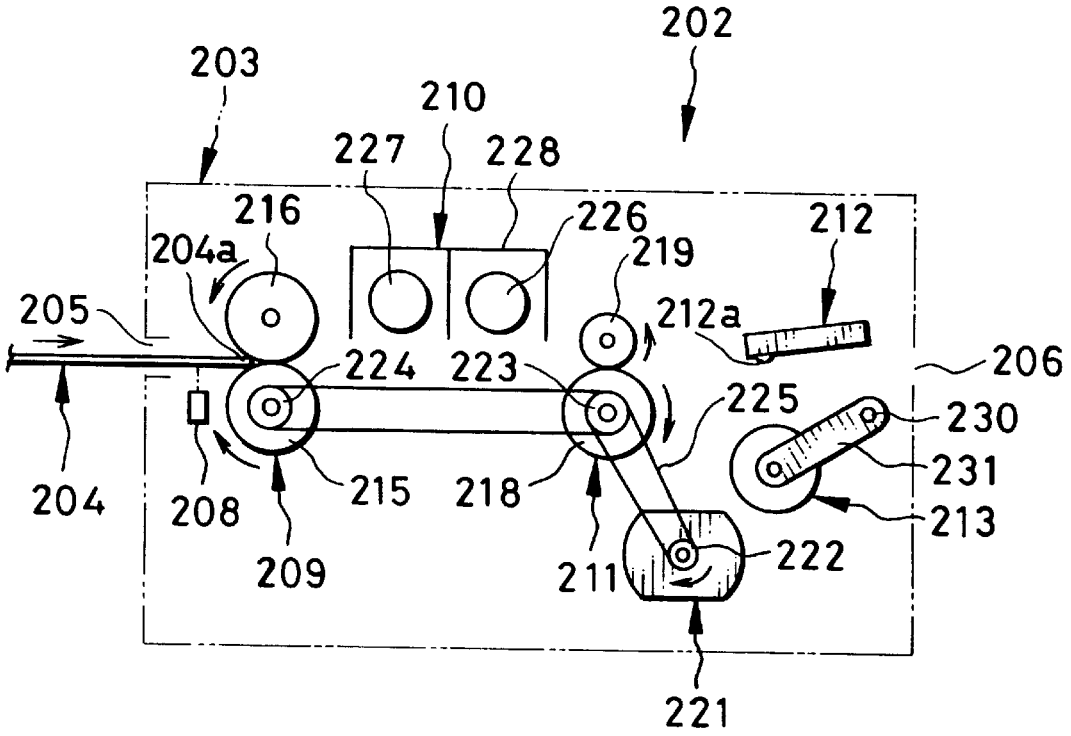
FIG. 24 is an explanatory view in elevation, illustrating another preferred color thermal printer, having a state of a sheet supply.

This problem is solved in a color thermal printer 202 of FIG. 24. A printer body 203 incorporates various parts of the thermal printer 202. A front panel of the thermal printer 202 has an entrance opening 205 through which a color thermosensitive recording sheet 204 being unused is inserted manually, and is exited from the printer body 203 after being colored. A rear panel of the thermal printer 202 opposite to the entrance opening 205 has an auxiliary opening 206 through which a portion of the recording sheet 204 appears externally in the course of the printing operation. At least one portion of the recording sheet 204 is caused to appear outside the printer body 203 in the course of the printing, so that the conveying passageway of the recording sheet 204 in the printer body 203 is shortened. The side of the thermal printer 202 is reduced.

In a position inward from the entrance opening 205, there is a reflection type of photo sensor 208 for detecting a line of first margin 204*a* of the recording sheet 204 inserted into the entrance opening 205. The inside of the printer accommodates a first set of conveyor rollers or ejector roller set 209 as a conveyor unit, an optical fixer 210, a second set of conveyor rollers or feeder roller set 211, a thermal head 212 and a platen roller 213.

The ejector roller set 209 squeezes the recording sheet 204 from the entrance opening 205 and supplies the printer body 203 with the recording sheet 204. Also after the printing operation, the ejector roller set 209 ejects the recording sheet 204 through the entrance opening 205. The ejector roller set 209 is constituted by a capstan roller 215 to be driven directly, and a nip roller 216 rotated together with the capstan roller 215. A spring (not shown) having a small bias force keeps the nip roller 216 in contact with the capstan roller 215.

The feeder roller set 211 conveys the recording sheet relative to the thermal head 212 during the thermal printing, and is constituted by a capstan roller 218 and a nip roller 219, which has a smaller diameter than the capstan roller 218, and is rotated by rotation of the capstan roller 218. The nip roller 219 is constantly kept in contact with the capstan roller 218 by a spring (not shown) having a strong biasing force, and conveys the recording sheet 204 in a slip-free state.

The capstan roller 215 of the ejector roller set 209 and the capstan roller 218 of the feeder roller set 211 are driven by a stepping motor 221. Rotation of the stepping motor 221 is transmitted to the capstan rollers 215 and 218 by cooperation of pulleys 222, 223 and 224 and belts 225 and 236 disposed on their periphery.

The optical fixer 210 is disposed between the ejector roller set 209 and the feeder roller set 211. The optical fixer 210 is constituted by a yellow fixer lamp 226, a magenta fixer lamp 227 and a reflector 228. The yellow fixer lamp 226 emanates visible violet rays or near ultraviolet rays in a wavelength range peaking at the wavelength of 420 nm, and fixes the yellow coloring layer. The magenta fixer lamp 227 emanates ultraviolet rays in a wavelength range peaking at the wavelength of 365 nm, and fixes the magenta coloring layer. The reflector 228 covers tops and sides of the fixer lamps 226 and 227, and reflects the rays toward the recording sheet 204.

The thermal head 212 includes an array of heating elements 212*a* which are arranged in line perpendicular to the conveying direction of the recording sheet 204. The thermal head 212 is disposed in a stationary manner. The heating element array 212*a* generates heat energy to the coloring layers of the recording sheet 204.

Figure 25:
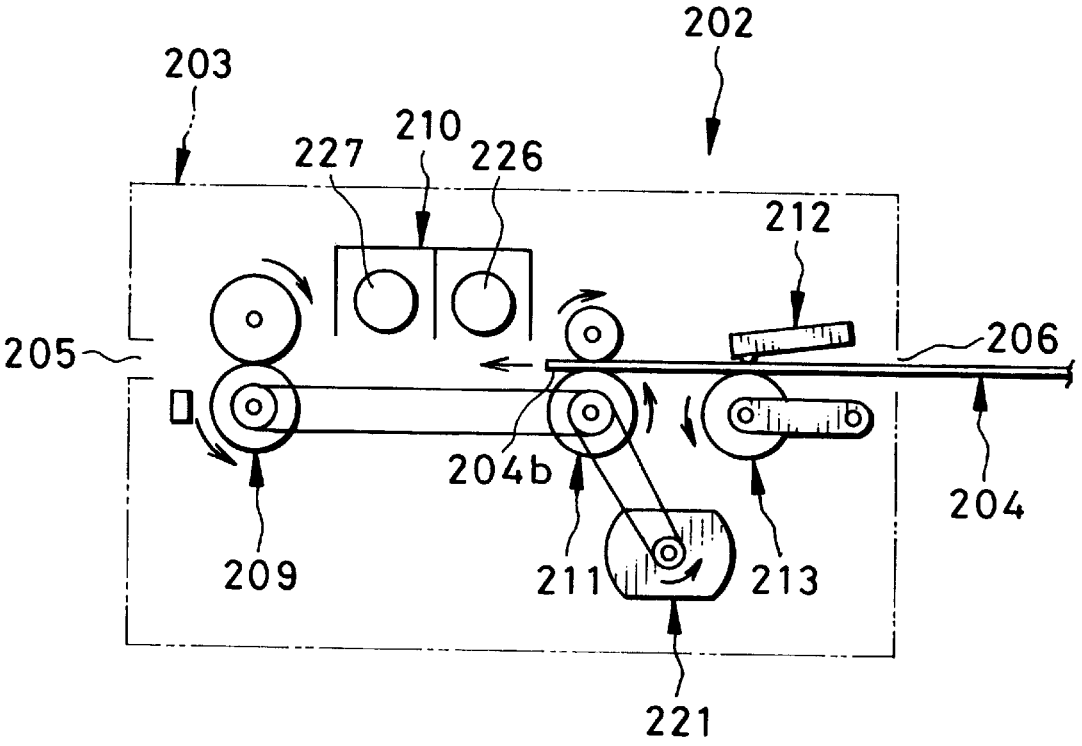
FIG. 25 is an explanatory view in elevation, illustrating a state of a start of thermal recording.

The thermal head 212 is supported by a support lever 231, which is rotated about a shaft 230 by a rotating mechanism (not shown). In the thermal printing, the thermal head 212 is rotated upwards as depicted in FIG. 25, and squeezes the recording sheet 204 between it and the heating element array 212*a* of the thermal head 212.

The recording sheet 204 includes a support, a cyan thermosensitive coloring layer, a magenta thermosensitive coloring layer and a yellow thermosensitive coloring layer. It is possible to add a black thermosensitive coloring layer to the three coloring layers of the recording sheet 204.

Figure 26:
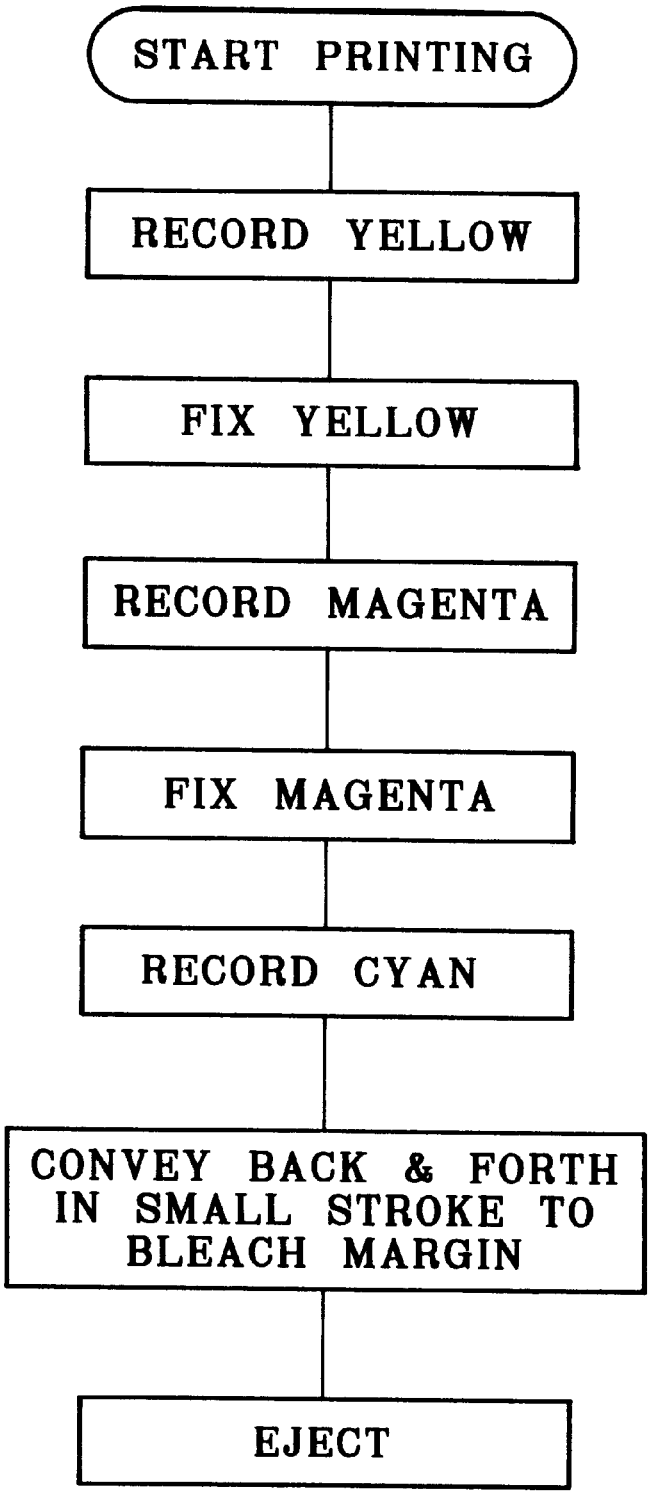
FIG. 26 is a flow chart illustrating the operation of the thermal printer.

The operation of the present embodiment is described with reference to FIG. 26. The thermal printer 202 is connected with a video instrument, for example a computer. When a user enters a print start command through the computer, print data is sent by the computer to the thermal printer 202, which is caused to stand by for printing operation.

When the thermal printer 202 stands by for the printing operation, an insertion instructing lamp (not shown) on the front of the printer body 203 is caused to blink to inform a user of the standby condition and requirement of the recording sheet 204.

In FIG. 24, the recording sheet 204 is inserted into the entrance opening 205. The first margin 204*a* of the recording sheet 204 pushes the ejector roller set 209. In the course of insertion of the recording sheet 204, the line of the first margin 204*a* is detected by the photo sensor 208. Upon the detection of the first margin 204*a*, a detection signal from the photo sensor 208 causes the stepping motor 221 to rotate in a forward direction, which is clockwise in the drawing, so that the capstan roller 215 is caused to rotate clockwise by means of the pulleys 222–224 and the belts 225 and 236. The nip roller 216 in contact with the capstan roller 215 is rotated in the counterclockwise direction, to nip the first margin 204*a* of the recording sheet 204.

The recording sheet 204 conveyed by the ejector roller set 209 is moved under the optical fixer 210, until the first margin 204*a* becomes nipped by the feeder roller set 211. The recording sheet 204 is caused by the first and second conveyor roller sets 209 and 211 to come between the thermal head 212 and the platen roller 213, and becomes protruded out of the auxiliary opening 206. See FIG. 25. The stepping motor 221 stops while a second margin 204*b* of the recording sheet 204 remains squeezed by the feeder roller set 211.

When the recording sheet 204 stops being conveyed, the rotating mechanism (not shown) rotates the support lever 231 to move the platen roller 213 to the thermal head 212. The recording sheet 204 is squeezed between the platen roller 213 and the heating element array 212*a* of the thermal head 212.

When the stepping motor 221 rotates in reverse, the feeder roller set 211 conveys the recording sheet 204 by advancing the second margin 204*b*. The platen roller 213 is caused to rotate by movement of the recording sheet 204. When a start position of a recording region comes to the heating element array 212*a* during the conveyance, the heating elements generates heat energy according to respective pixels of a yellow image, which is recorded to the yellow coloring layer one line after another.

Figure 27:
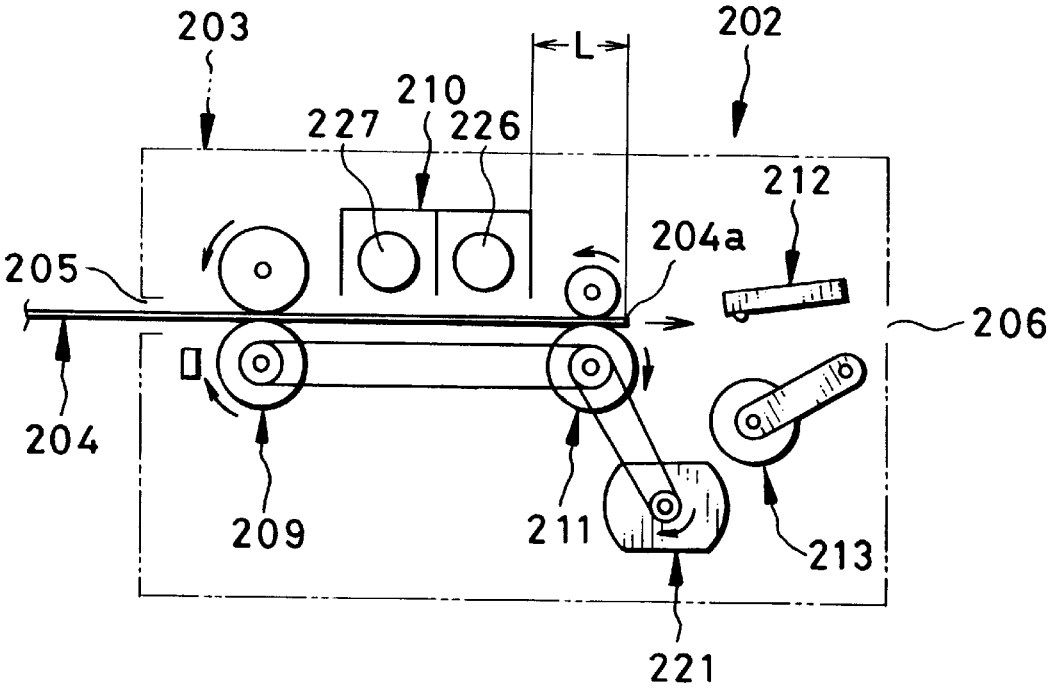
FIG. 27 is an explanatory view in elevation, illustrating a state of a start of fixation of a recording region.

The recording sheet 204 after the yellow recording is nipped by the ejector roller set 209 again, and partially protruded through the entrance opening 205. Upon the finish of the yellow recording to the recording sheet 204, the thermal head 212 stops being driven. The platen roller 213 rotates to the retracted position away from the thermal head 212. In FIG. 27, the stepping motor 221 is stopped in a state with the first margin 204*a* of the recording sheet 204 nipped by the feeder roller set 211.

Immediately after the stepping motor 221 stops, the yellow fixer lamp 226 is turned on. Again the stepping motor 221 starts rotating forwards, so as to convey the recording sheet 204 toward the auxiliary opening 206 by advancing the first margin 204*a*. During the conveyance the yellow fixer lamp 226 emanates near ultraviolet rays of 420 nm to the recording sheet 204, to fix the yellow coloring layer for avoidance of further yellow coloring in the course of the magenta recording. In the drawing, a letter L designates a margin region on the recording sheet 204. The yellow fixer lamp 226 does not apply rays to the margin region L in the course of the yellow fixation.

A front edge of a recording region of the recording sheet 204 is conveyed to come again to the heating element array 212*a*. The stepping motor 221 is stopped to turn off the yellow fixer lamp 226. In FIG. 25, the platen roller 213 is pushed to the thermal head 212 again. The stepping motor 221 is rotated backwards, to convey the recording sheet 204 by advancing the second margin 204*b*. The thermal head 212 applies heat energy to the magenta coloring layer to record the magenta color to the recording sheet.

After the magenta image is recorded to the end position of the recording region short of the first margin 204*a* of the recording sheet 204, the platen roller 213 is shifted again to the retreat position, to release the recording sheet 204 from pressure. See FIG. 27. The stepping motor 221 stops. Then the magenta fixer lamp 227 is turned on. Again the stepping motor 221 starts rotating forwards, to convey the recording sheet 204 toward the auxiliary opening 206 by advancing the first margin 204*a*. During the conveyance the magenta fixer lamp 227 emanates ultraviolet rays of 365 nm to the recording sheet 204, to fix the magenta coloring layer for avoidance of further magenta coloring in the course of the cyan recording.

The front edge of the recording region of the recording sheet 204 is conveyed to the heating element array 212*a*. The platen roller 213 is pushed to the thermal head 212 again for the thermal recording. The stepping motor 221 is rotated backwards, to convey the recording sheet 204 by advancing the second margin 204*b*. The thermal head 212 records the cyan color to the recording sheet.

Figure 28:
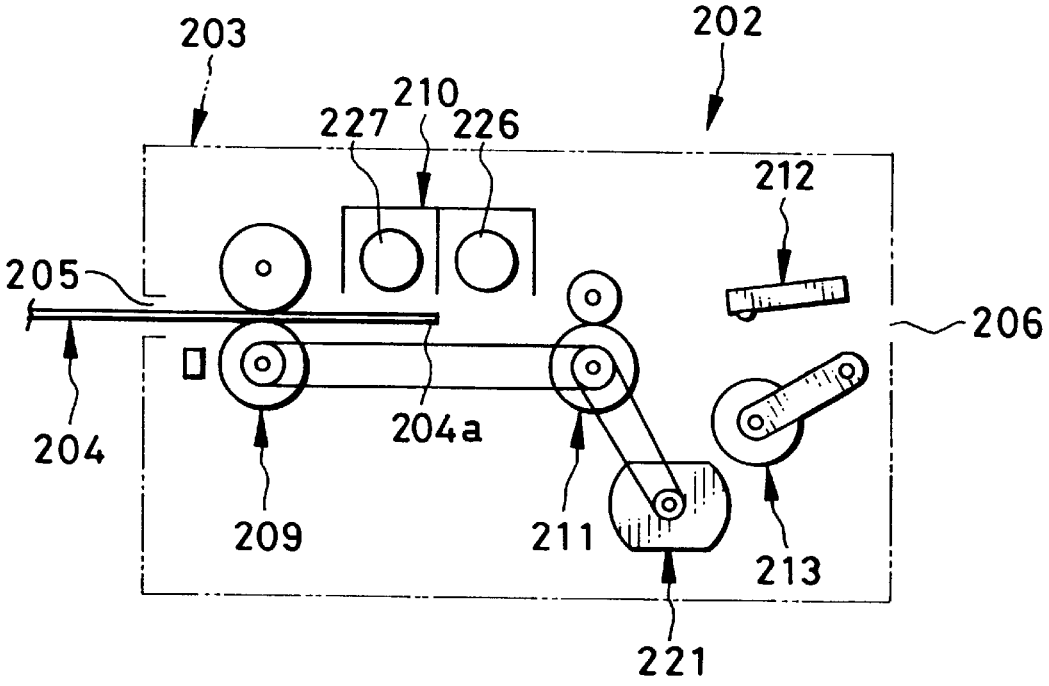
FIG. 28 is an explanatory view in elevation, illustrating a state of a start of fixation of a front margin.

After thermal recording to all the three coloring layers is finished, the platen roller 213 moves back to the retreat position. In FIG. 28, the stepping motor 221 further rotates in the reverse direction, to protrude a portion of the recording sheet 204 from the entrance opening 205, before the margin region L is confronted with the magenta fixer lamp 27 and stopped.

Figure 29:
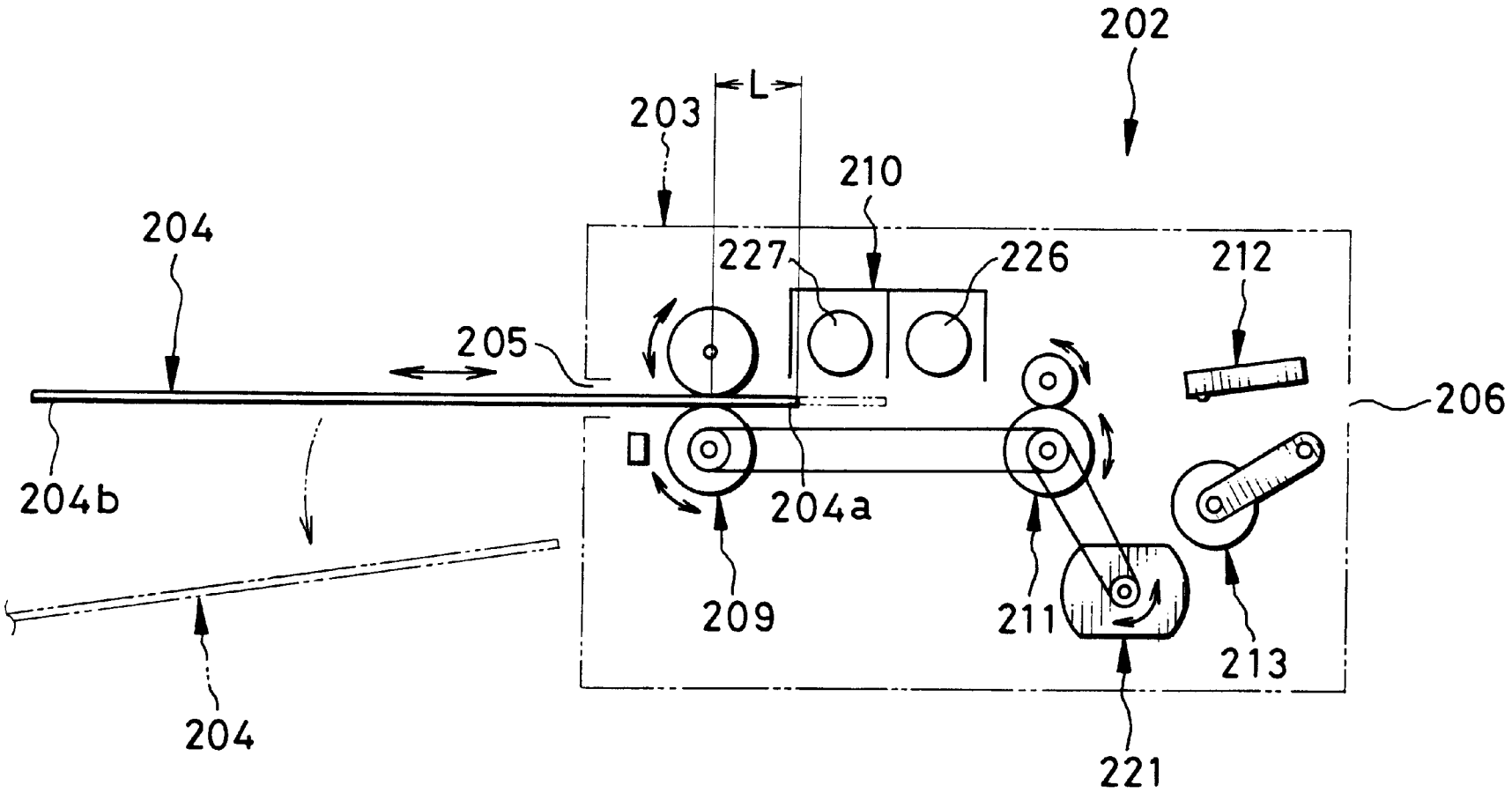
FIG. 29 is an explanatory view in elevation, illustrating a state of continuing fixation of the front margin.

In FIG. 29, the magenta fixer lamp 227 is turned on immediately after the stop of the stepping motor 221. Then the stepping motor 221 is caused to rotate alternately in the forward and backward directions in such a range that the margin region L of the recording sheet 204 does not come out of a ray applying range of the magenta fixer lamp 227. Therefore the margin region L of the recording sheet 204 is optically fixed and bleached.

The user recognizes the finished state of the printing operation because of the back-and-forth movement of the recording sheet 204. There is no stop of the recording sheet 204 during the bleaching of the margin region L. The recording sheet 204 is kept from being pulled out of the entrance opening 205, because the user does not misunderstand the bleaching operation. The margin region L can be fixed and bleached appropriately.

After the back-and-forth conveyance of the recording sheet 204 for fixation of the margin region L, then the stepping motor 221 continuously rotates in the backward direction. The recording sheet 204 is ejected out of the entrance opening 205.

Figure 30:
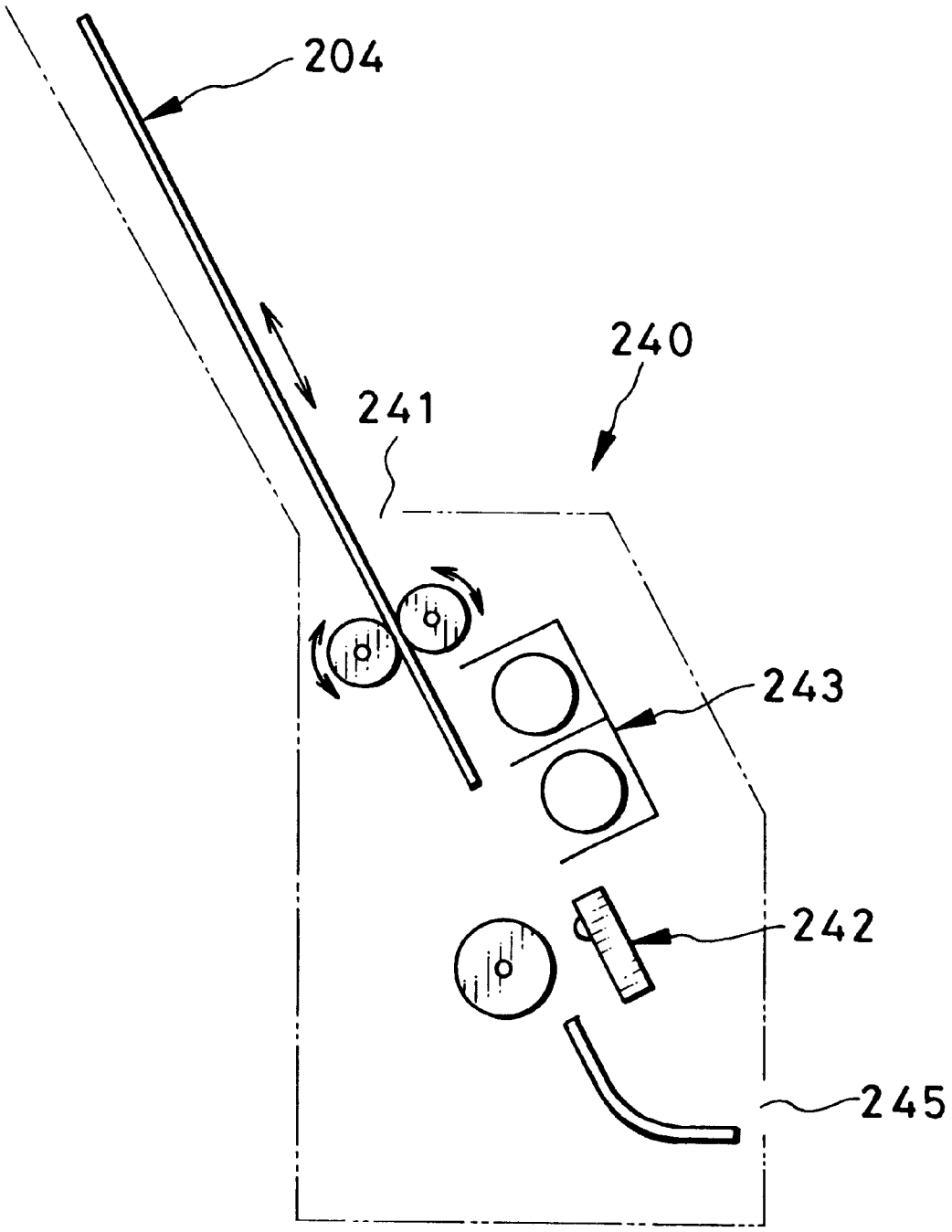
FIG. 30 is an explanatory view in elevation, illustrating another preferred thermal printer in which the recording sheet is conveyed with an inclination.
Figure 31:
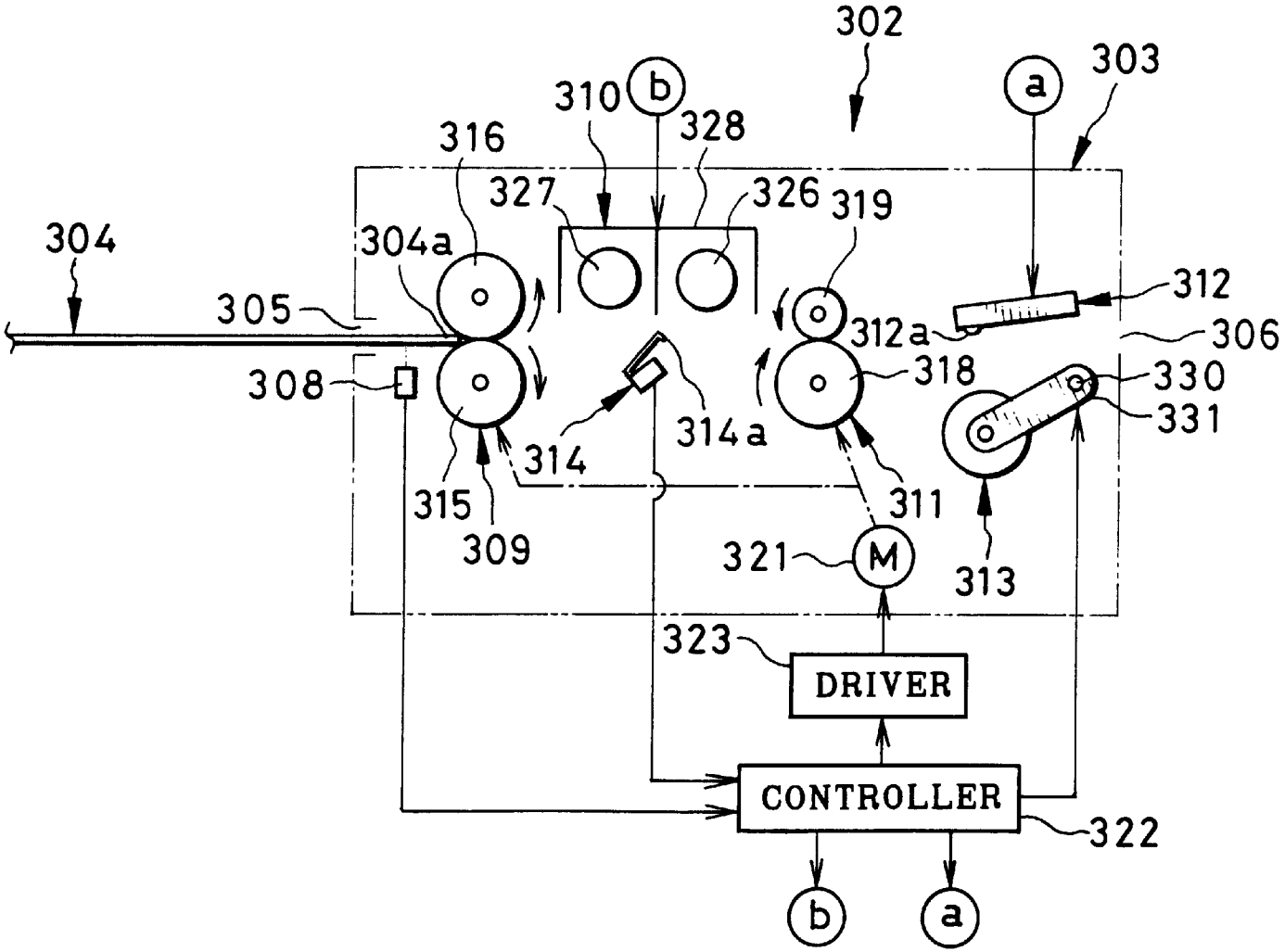
FIG. 31 is an explanatory view in elevation, illustrating still another preferred color thermal printer, having a state of a sheet supply.

In the above embodiment, the recording sheet 204 is conveyed horizontally. Alternatively the recording sheet 204 may be conveyed erectly with an inclination as depicted in FIG. 30. A color thermal printer 240 has an entrance opening 241 through which the recording sheet 204 is supplied. A thermal head 242 prints the three colors to the recording sheet 204, which is fixed by an optical fixer 243. A portion of the recording sheet 204 is caused to appear externally through an auxiliary opening 245. After the printing operation the recording sheet 204 is ejected up through the entrance opening 241.

In the above embodiment, the recording sheet 204 is conveyed back and forth within the small range for the purpose of bleaching the margin region L. Alternatively the recording sheet 204 may be conveyed intermittently within the same small range by a unit length being predetermined still smaller, for the purpose of bleaching the margin region L.

In the above embodiments, the thermal printer is a three-pass one-head type in which a single thermal head is used for three-time thermal recording. Of course a thermal printer in the present invention may be a one-pass three-head type in which three thermal heads are used for one-time thermal recording of one full-color image. In the above embodiments, the thermal printer is a color printer for recording a full-color image. Alternatively a thermal printer in the present invention may be a monochromatic printer.

In the above embodiment, the recording sheet as a single piece is used in the printing operation. Alternatively a continuous recording sheet of a roll may be used in another type of thermal printer in the present invention. The thermal printer may be supplied successively with the continuously sheet. The continuous recording sheet after the printing operation may be cut into each piece of sheet.

Still another preferred embodiment is illustrated in FIGS. 31–37, in which a margin of the recording sheet is fixed and bleached before the thermal recording and immediately after the sheet supply.

In a position inward from an entrance opening 305, there is a reflection type of photo sensor 308 for detecting a line of a first margin 304*a* of a color thermosensitive recording sheet 304 inserted into the entrance opening 305. The inside of the printer accommodates a first set of conveyor rollers or supply roller set 309 as a conveyor unit, an optical fixer 310, a micro switch 314, a second set of conveyor rollers or feeder roller set 311, a thermal head 312 and a platen roller 313. A color thermal printer 302 is controlled by a controller 322 which consists of a computer. When the photo sensor 308 detects the line of the first margin 304*a* of the recording sheet 304, it outputs a detection signal which is sent to the controller 322.

A capstan roller 315 of the supply roller set 309 and a capstan roller 318 of the feeder roller set 311 are driven by a stepping motor 321. The stepping motor 321 is driven by a driver 323, which is controlled by the controller 322.

Figure 32:
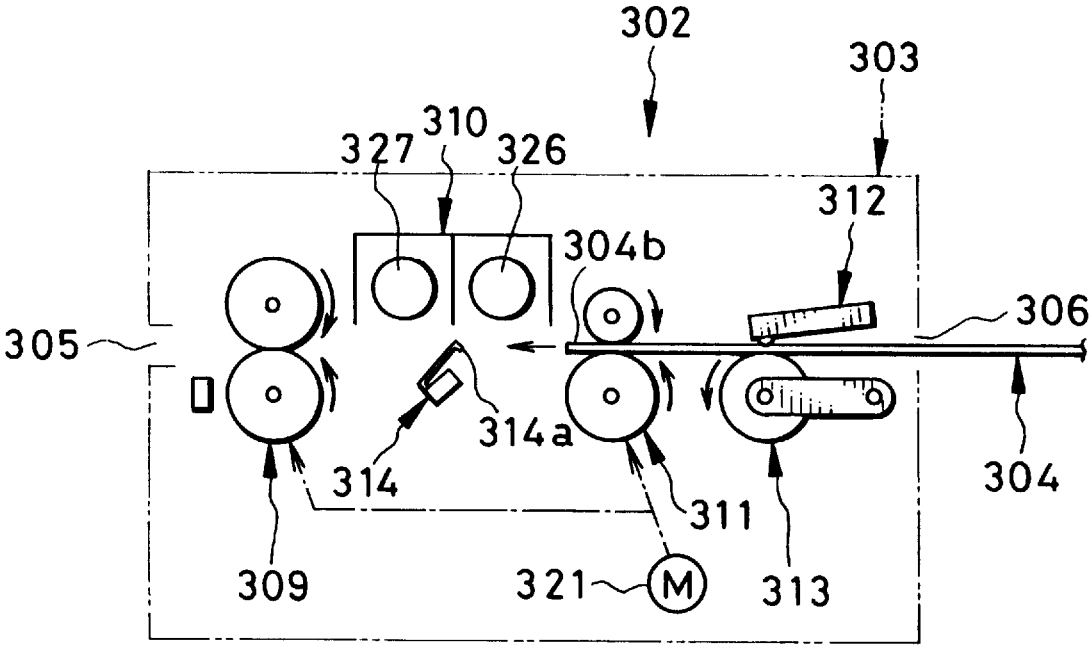
FIG. 32 is an explanatory view in elevation, illustrating a state of a start of thermal recording.
Figure 33:
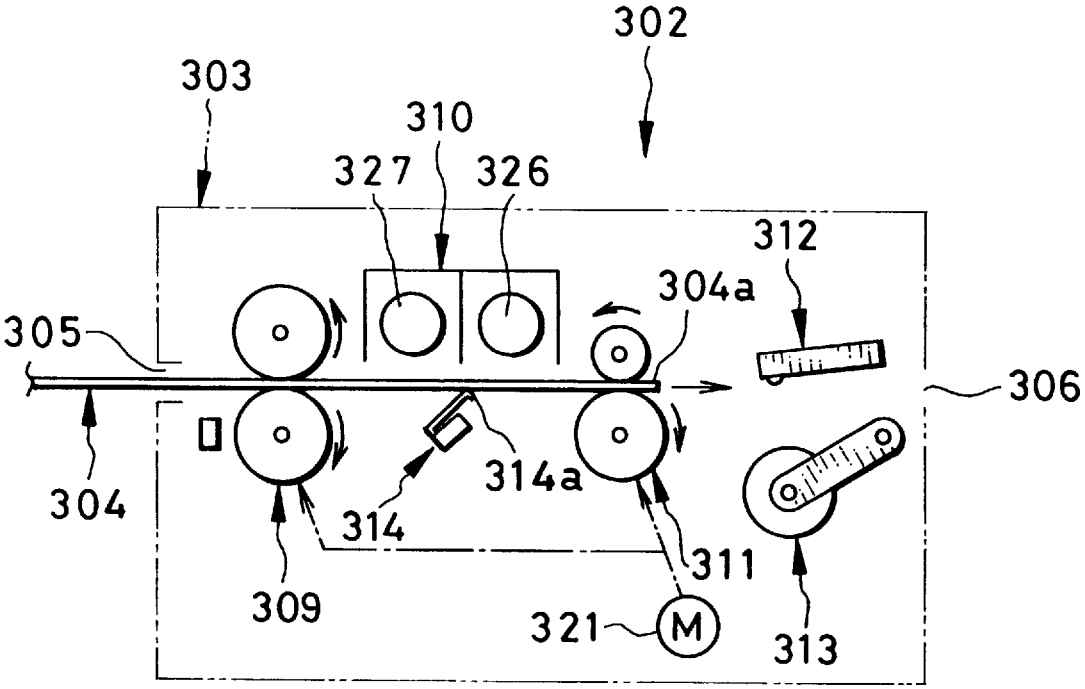
FIG. 33 is an explanatory view in elevation, illustrating a state of a start of fixation of a recording region.
Figure 34:
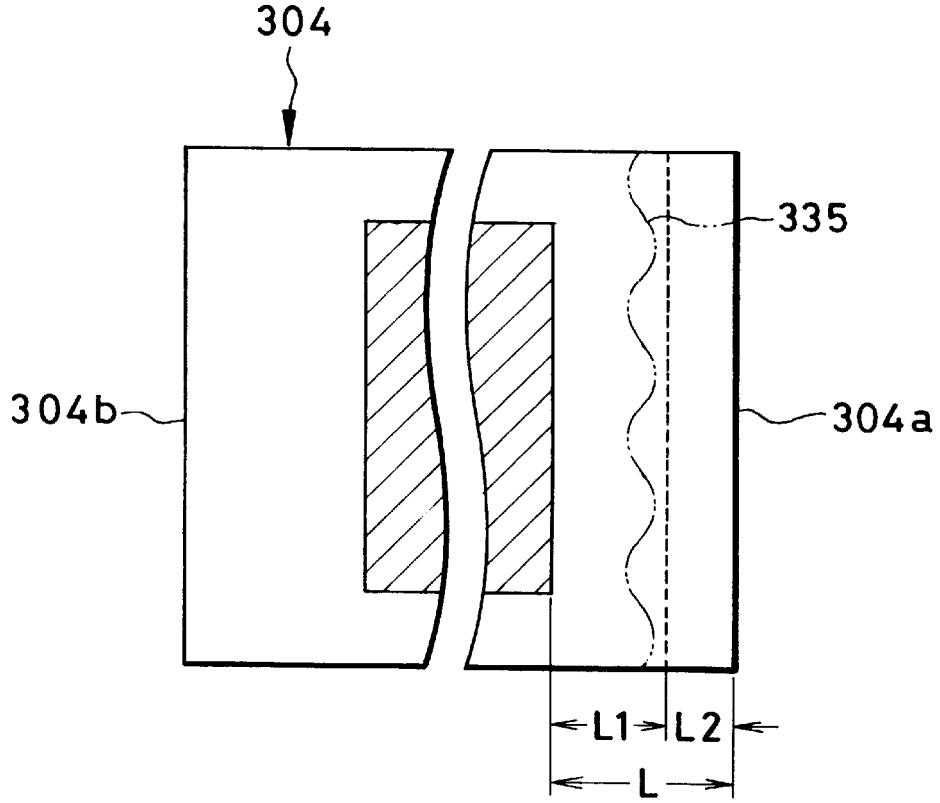
FIG. 34 is an explanatory view in plan, illustrating the recording sheet.
Figure 37:
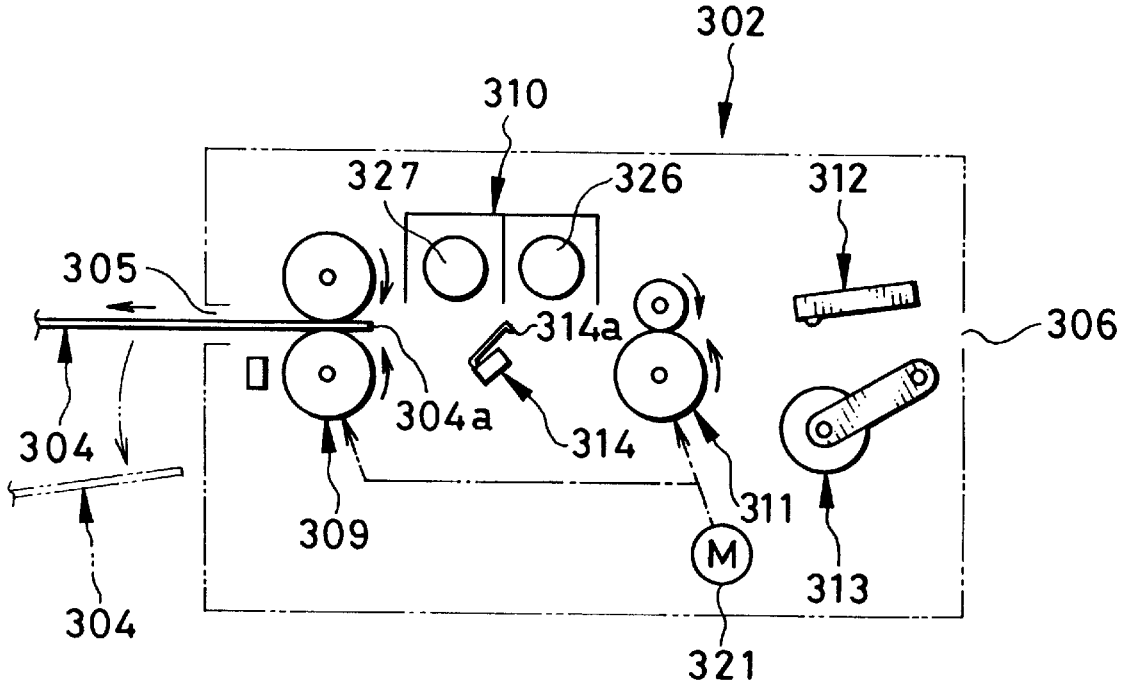
FIG. 37 is an explanatory view in elevation, illustrating a state of ejection the recording sheet.
Figure 35:
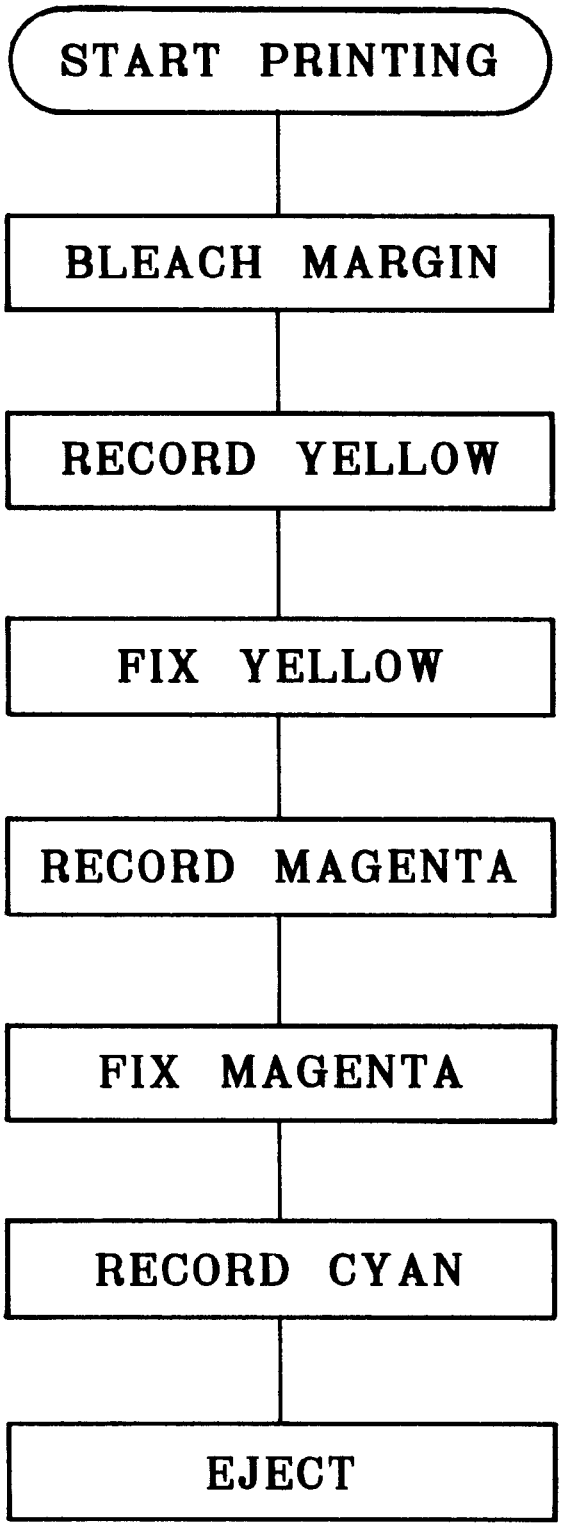
FIG. 35 is a flow chart, illustrating the operation of the thermal printer.

In FIG. 32, the recording sheet 304 is conveyed by advancing a second margin 304*b* to the left as viewed in the drawing, while the thermal head 312 thermally records three-color images. In FIG. 33, the recording sheet 304 is conveyed by advancing the first margin 304*a* to the right as viewed in the drawing, while the optical fixer 310 optically fixes the coloring layers. In FIG. 34, a full-color image is recorded on a recording region located in the center about which blank spaces are formed without any image. A margin region L formed on the first margin 304*a* of the recording sheet 304 does not become confronted with the optical fixer 310 during the printing operation. Although a region L1 included in the margin region L is fixed by reflected rays from a reflector 328, yet a region L2 within the margin region L remains unfixed, because nipped by the feeder roller set 311.

The micro switch 314 includes a plunger 314*a*, which is contacted by the line of the first margin 304*a* of the recording sheet 304. The contact of the first margin 304*a* turns the micro switch 314 on. The micro switch 314 generates a detection signal, which is sent to the controller 322.

In operation of the present embodiment, the recording sheet 304 is at first inserted in the entrance opening 305. See FIG. 31. The first margin 304*a* of the recording sheet 304 is contacted by the supply roller set 309. During the insertion of the recording sheet 304, the line of the first margin 304*a* is detected by the photo sensor 308, of which a detection signal is sent to the controller 322.

In response to a detection signal from the photo sensor 308, the controller 322 causes the driver 323 to rotates the stepping motor 321 in the forward direction, so that the capstan rollers 315 and 318 are rotated in the clockwise direction. A pinch roller 316 is rotated by the contact with the capstan roller 315 in the counterclockwise direction, to nip the first margin 304*a* of the recording sheet 304.

Figure 36:
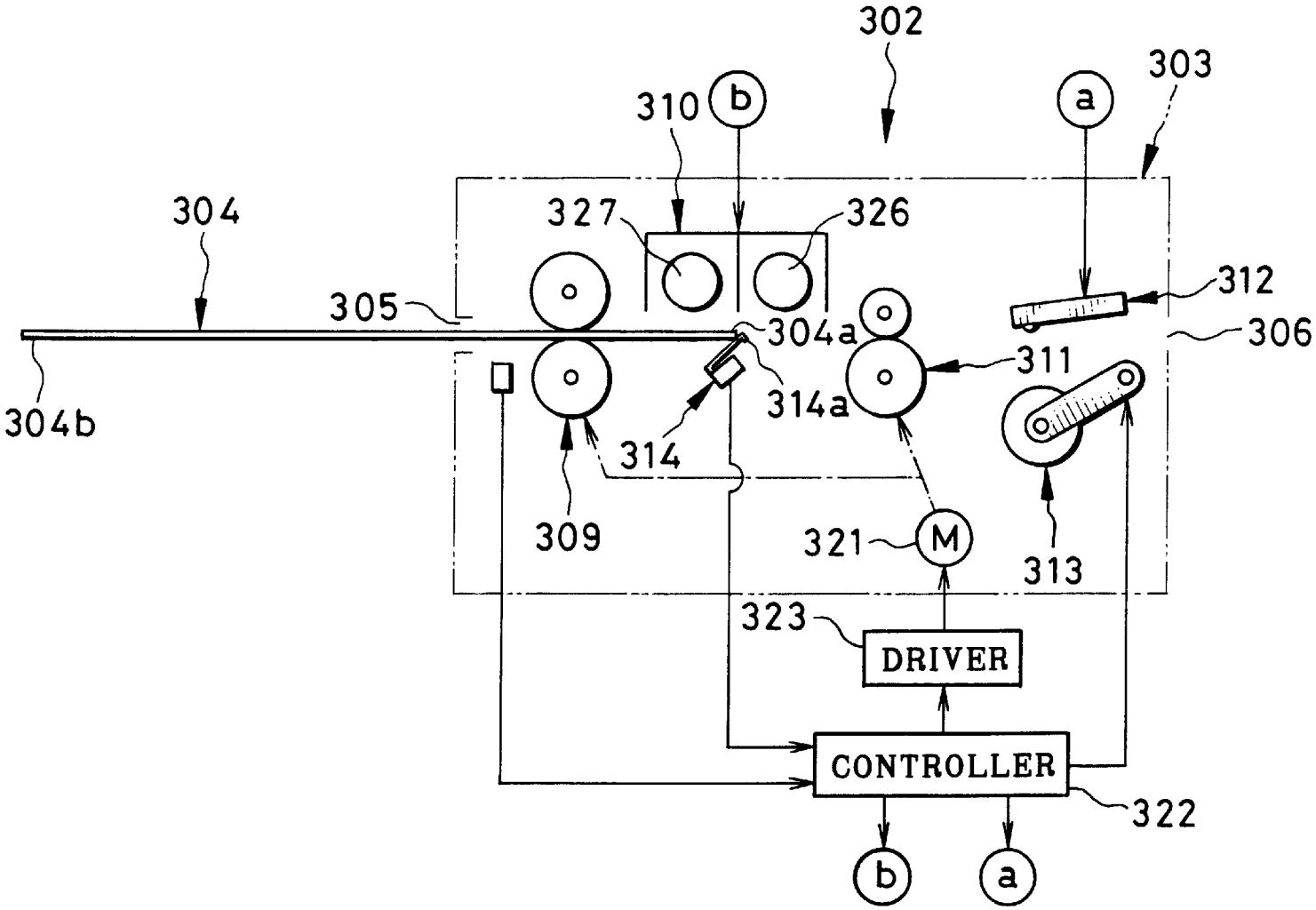
FIG. 36 is an explanatory view in elevation, illustrating a state of continuing fixation of the front margin.

The recording sheet 304 conveyed by the supply roller set 309 is moved under the optical fixer 310. In FIG. 36, the first margin 304*a* comes in contact with the plunger 314*a* of the micro switch 314. The micro switch 314 being turned on, a signal from the micro switch 314 is sent to the controller 322, which responsively stops the stepping motor 321. Consequently the margin region L of the first margin 304*a* of the recording sheet 304 is stopped and confronted with a magenta fixer lamp 327. See FIG. 34.

At the same time as the stepping motor 321 stops, the controller 322 turns on the magenta fixer lamp 327 of the optical fixer 310, to bleach a region which is defined between the line of the first margin 304*a* and a curved broken line 335 indicated in FIG. 34. This bleached region is overlapped with a range L1 which will be bleached in the course of printing operation. Consequently the entirety of the margin region L can be bleached.

This being so, the margin region of the recording sheet 304 is bleached upon supply of the recording sheet and before the printing. The recording sheet 304 after finishing the printing operation can be ejected immediately. The recording sheet 304 can be prevented from being forcibly pulled out of the printer body in the course of bleaching which would follow the thermal recording. It is possible to shorten the total time required for obtaining a full-color image, because the step of standby for printing has been a cause of increasing the total time of the printing, but utilized for the previous bleaching in the present embodiment.

After the magenta fixer lamp 327 is kept turned on for the predetermined duration of time by the controller 322, the controller 322 turns off the magenta fixer lamp 327. After the printer comes to stand by again for printing operation, the controller 322 causes the stepping motor 321 to rotate again.

The recording sheet 304 is conveyed by the supply roller set 309 toward the thermal head 312 while the first margin 304*a* is advanced. The recording sheet 304 is nipped by the feeder roller set 311. The recording sheet 304 conveyed by the supply roller set 309 and the feeder roller set 311 passes between the thermal head 312 and the platen roller 313. In FIG. 32, the recording sheet 304 is protruded from the inside of the thermal printer 302 through an auxiliary opening 306. The controller 322 stops the stepping motor 321 while the second margin 304*b* of the recording sheet 304 remains nipped by the feeder roller set 311.

In the present embodiment, a reference numeral 303 designates a printer body, 312*a* an array of heating elements, 319 a nip roller, 326 a yellow fixer lamp, 330 a shaft, and 331 a support lever.

Figure 38:
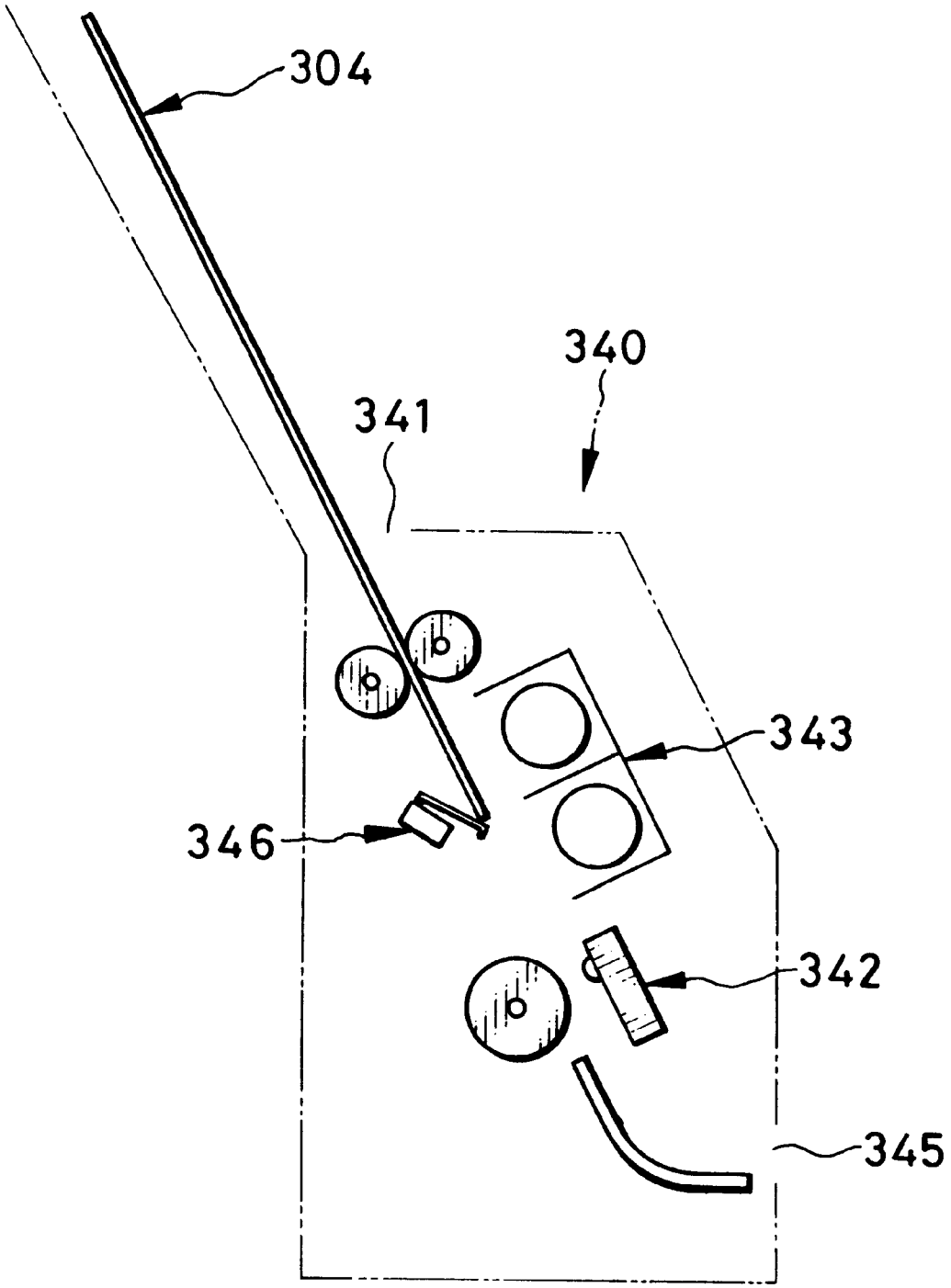
FIG. 38 is an explanatory view in elevation, illustrating another preferred thermal printer in which the recording sheet is conveyed with an inclination.

In the above embodiment, the recording sheet 304 is conveyed horizontally. Alternatively the recording sheet 304 may be conveyed erectly with an inclination as depicted in FIG. 38. A color thermal printer 340 has an entrance opening 341 through which the recording sheet 304 is supplied. A thermal head 342 prints the three colors to the recording sheet 304, which is fixed by an optical fixer 343. A portion of the recording sheet 304 is caused to appear externally through an auxiliary opening 345. After the printing operation the recording sheet 304 is ejected up through the entrance opening 341. Of course the thermal printer 340 has a micro switch 346 for detecting one margin line of the recording sheet 304.

In the above embodiments, the recording sheet is partially protruded from the inside of the printer in the printing operation. Of course the thermal printer of the present invention may be a type in which the entirety of the recording sheet is contained inside a printer body in the printing operation.

The embodiments of FIGS. 30 and 38 do not have feeder rollers between the fixer and the thermal head. Of course such an upright type of thermal printer in the present invention may include feeder rollers between the fixer and the thermal head.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer for recording an image on thermosensitive recording material, said recording material includes a support, and at least one thermosensitive coloring layer, formed on said support, colorable with heat, and fixable with electromagnetic rays, said recording material having first and second side portions substantially parallel to each other, said thermal printer comprising:

a paper feeder for conveying said recording material along a conveying path;

a thermal head for heating and coloring said coloring layer while said recording material is conveyed along said conveying path;

a fixer for fixing said coloring layer by applying said electromagnetic rays to said recording material while said recording material being colored is conveyed past a ray applying region;

first and second paper guides, disposed in said conveying path substantially parallel to each other, for guiding respectively said first and second side portions; and plural gaps formed in portions of said first and second paper guides disposed in said ray applying region, said first and second gaps allowing said electromagnetic rays to pass toward said first and second side portions.

2. A thermal printer as defined in claim 1, wherein said first and second paper guides are transparent.

3. A thermal printer as defined in claim 2, wherein said first and second paper guides have a channel shape.

4. A thermal printer as defined in claim 3, wherein said thermal head and said fixer are disposed under said conveying path, and said recording material is conveyed with said support upwards oriented.

5. A thermal printer as defined in claim 1, wherein said at least one coloring layer comprises at least first to third coloring layers overlaid on said support in sequence, said third and second coloring layers being fixable with said electromagnetic rays of respectively first and second wavelength ranges, said third, second and first coloring layers being colored in sequence in a frame-sequential manner.

6. A thermal printer as defined in claim 5, wherein said fixer includes first and second fixer lamps extending crosswise to a direction of said conveying path;

wherein after said third coloring layer is colored, said first fixer lamp applies said electromagnetic rays of said first wavelength range to said recording material to fix said third coloring material; and after said second coloring layer is colored, said second fixer lamp applies said electromagnetic rays of said second wavelength range to said recording material to fix said second coloring material, and after said first coloring layer is colored, aid second fixer lamp applies said electromagnetic rays of said second wavelength range to said recording material to bleach a margin region located outside said image.

7. A thermal printer as defined in claim 6, wherein said first and second paper guides include plural teeth arranged in a comb shape, and said plural gaps are defined between said plural teeth.

8. A thermal printer as defined in claim 7, wherein said plural teeth have a rectangular shape as viewed in cross section.

9. A thermal printer as defined in claim 7, wherein said plural teeth have a rod shape.

10. A thermal printer as defined in claim 7, wherein said plural teeth have a shape of a polygonal prism.

11. A thermal printer as defined in claim 7, wherein said paper feeder includes a pair of feeder rollers for nipping and conveying said recording material being colored and fixed, and at least one ejector roller for ejecting said recording material.

12. A thermal printer as defined in claim 11, wherein said pair of said feeder rollers include a capstan roller driven by a motor, and a pinch roller.

13. A thermal printer as defined in claim 11, wherein said ejector roller, said fixer, said pair of said feeder rollers and said thermal head are arranged in sequence;

said pair of said feeder rollers convey said recording material back and forth in first and second directions, said first direction being from said thermal head toward said fixer, and said second direction being reverse to said first direction, and said pair of said feeder rollers being changed over between said first and second directions when said feeder rollers nip a first or second margin region of said recording material;

said thermal head records said image while said recording material is conveyed by advancing said first margin in said first direction; and said first and second fixer lamps fix said recording material while said recording material is conveyed by advancing in said first or second direction.

14. A thermal printer as defined in claim 13, wherein after said first coloring layer is colored, said pair of said feeder rollers rotate to move said second margin region past said pair of said feeder rollers, and after moving said second margin region past said pair of said feeder rollers, said ejector roller conveys said recording material in said first direction to eject said recording material.

15. A thermal printer as defined in claim 14, wherein said second fixer lamp applies said electromagnetic rays of said second wavelength range to bleach said margin region while said recording material is conveyed in said first direction for coloring said first coloring layer and then for ejecting said recording material.

16. A thermal printer as defined in claim 15, wherein an ejecting speed of said ejector roller decreases when said second margin region moves past a ray applying region of said second fixer lamp.

17. A thermal printer as defined in claim 15, wherein said ejector roller conveys said recording material by a unit length when said second margin region moves past a ray applying region of said second fixer lamp, and said unit length being a width of said gaps viewed in sad first direction.

18. A thermal printer as defined in claim 16 or 17, wherein said first fixer lamp is nearer to said pair of said feeder rollers, and said second fixer lamp is nearer to said ejector roller.

19. A thermal printer for recording an image on thermosensitive recording material, wherein said recording material has a sheet shape with first and second margin portions, and includes a support, and at least first to third coloring layers, overlaid on said support in sequence, and colorable with heat in colors different from each other, said third and second coloring layers being fixable with electromagnetic rays of respectively first and second wavelength ranges, said thermal printer comprising:

a thermal head, a pair of feeder rollers, a fixer, at least one ejector roller arranged in sequence along a conveying path, and means for controlling said thermal head, said pair of feeder rollers, said fixer, and said at least one ejector roller so that:

said pair of said feeder rollers nip and convey said recording material back and forth in first and second directions, said first direction being from said thermal head toward said fixer, and said second direction being reverse to said first direction, and said pair of said feeder rollers being changed over between said first and second directions when said feeder rollers nip said first or second margin portion of said recording material;

while said recording material is conveyed in said first direction for three times serially by advancing said first margin portion, said thermal head heats and colors said third, second and first coloring layers in sequence in a frame-sequential manner;

while said recording material is conveyed in said first or second direction after coloring said third coloring layer, then said fixer applies said electromagnetic rays of said first wavelength range to said recording material in a ray applying region thereof, to fix said third coloring layer, and while said recording material is conveyed in said first or second direction after coloring said second coloring layer, then said fixer applies said electromagnetic rays of said second wavelength range to said recording material in said ray applying region, to fix said second coloring layer, and while said recording material is conveyed in said first direction for coloring said first coloring layer and for ejecting said recording material, then said fixer applies said electromagnetic rays of said second wavelength range to said recording material in said ray applying region; and after said second margin portion is conveyed past said pair of said feeder rollers, said ejector roller conveys said second margin portion back and forth for plural times within a range between said ejector roller and said pair of said feeder rollers, and ejects said recording material in said first direction.

20. A thermal printer as defined in claim 19, wherein said means for controlling controls said ejector roller to convey said second margin portion back and forth in said ray applying region.

21. A thermal printer for recording an image on thermosensitive recording material, wherein said recording material has a sheet shape with first and second margin portions, and includes a support, and at least first to third coloring layers, overlaid on said support in sequence, and colorable with heat in colors different from each other, said third and second coloring layers being fixable with electromagnetic rays of respectively first and second wavelength ranges, said thermal printer comprising:

a thermal head, a pair of feeder rollers, a fixer, at least one ejector roller arranged in sequence along a conveying path, and means for controlling said thermal head, said pair of feeder rollers, said fixer, and said at least one ejector roller so that:

said pair of said feeder rollers nip and convey said recording material back and forth in first and second directions, said first direction being from said thermal head toward said fixer, and said second direction being reverse to said first direction, and said pair of said feeder rollers being changed over between said first and second directions when said feeder rollers nip said first or second margin portion of said recording material;

while said recording material is conveyed in said first direction for three times serially by advancing said first margin portion, said thermal head heats and colors said third, second and first coloring layers in sequence in a frame-sequential manner;

while said recording material is conveyed in said first or second direction after coloring said third coloring layer, then said fixer applies said electromagnetic rays of said first wavelength range to said recording material in a ray applying region thereof, to fix said third coloring layer, and while said recording material is conveyed in said first or second direction after coloring said second coloring layer, then said fixer applies said electromagnetic rays of said second wavelength range to said recording material in said ray applying region, to fix said second coloring layer, and while said recording material is conveyed in said first direction for coloring said first coloring layer and for ejecting said recording material, then said fixer applies said electromagnetic rays of said second wavelength range to said recording material in said ray applying region; and after said second margin portion is conveyed past said pair of said feeder rollers, said ejector roller intermittently conveys said recording material in said first direction and ejects said recording material.

22. A thermal printer for recording an image on thermosensitive recording material, wherein said recording material has a sheet shape with first and second margin portions, and includes a support, and at least first to third coloring layers, overlaid on said support in sequence, and colorable with heat in colors different from each other, said third and second coloring layers being fixable with electromagnetic rays of respectively first and second wavelength ranges, said thermal printer comprising:

a thermal head, a pair of feeder rollers, a fixer, at least one ejector roller arranged in sequence along a conveying path, and means for controlling said thermal head, said pair of feeder rollers, said fixer, and said at least one ejector roller so that:

wherein said supply roller conveys said recording material toward said pair of said feeder rollers by advancing said second margin portion, and when said second margin portion is confronted with said fixer, stops for a predetermined time;

said pair of said feeder rollers nip said recording material from said supply roller, and convey said recording material back and forth in first and second directions, said first direction being from said thermal head toward said fixer, and said second direction being reverse to said first direction, and said pair of said feeder rollers being changed over between said first and second directions when said feeder rollers nip said first or second margin portion of said recording material;

while said recording material is conveyed in said first direction for three times serially by advancing said first margin portion, said thermal head heats and colors said third, second and first coloring layers in sequence in a frame-sequential manner; and while said recording material is conveyed in said first or second direction after coloring said third coloring layer, then said fixer applies said electromagnetic rays of said first wavelength range to said recording material in a ray applying region thereof, to fix said third coloring layer, and while said recording material is conveyed in said first or second direction after coloring said second coloring layer, then said fixer applies said electromagnetic rays of said second wavelength range to said recording material in said ray applying region, to fix said second coloring layer, and when said second margin portion is stopped in said ray applying region during supply of said recording material, then said fixer applies said electromagnetic rays of said second wavelength range to said recording material, to fix said second margin portion.

23. A thermal printer as defined in claim 22, wherein after said first coloring layer is colored, said means for controlling controls said supply roller to convey said recording material from said pair of said feeder rollers in said first direction, to eject said recording material.

24. A thermal printing method of recording an image on thermosensitive recording material, wherein said recording material has a sheet shape with first and second margin portions, and includes a support, and at least first to third coloring layers, overlaid on said support in sequence, and colorable with heat in colors different from each other, said third and second coloring layers being fixable with electromagnetic rays of respectively first and second wavelength ranges, said thermal printer comprising steps of:

conveying said recording material back and forth in first and second directions with a pair of feeder rollers, said second direction being reverse to said first direction, and said pair of said feeder rollers being changed over between said first and second directions when said feeder rollers nip said first or second margin portion of said recording material;

while said recording material is conveyed in said first direction for three times serially by advancing said first margin portion, heating and coloring said third, second and first coloring layers in sequence in a frame-sequential manner with a thermal head;

applying said electromagnetic rays of said first wavelength range to said recording material after coloring said third coloring layer, and applying said electromagnetic rays of said second wavelength range to said recording material after coloring said second coloring layer;

after coloring said first coloring layer, conveying said recording material in said first direction for ejecting said recording material;

while said recording material is conveyed in said first direction for ejection, applying said electromagnetic rays of said second wavelength range to said recording material;

conveying said second margin portion back and forth within a ray applying range of said electromagnetic rays of said second wavelength range, said recording material being then ejected.

25. A thermal printing method of recording an image on thermosensitive recording material, wherein said recording material has a sheet shape with first and second margin portions, and includes a support, and at least first to third coloring layers, overlaid on said support in sequence, and colorable with heat in colors different from each other, said third and second coloring layers being fixable with electromagnetic rays of respectively first and second wavelength ranges, said thermal printer comprising steps of:

conveying said recording material back and forth in first and second directions with a pair of feeder rollers, said second direction being reverse to said first direction, and said pair of said feeder rollers being changed over between said first and second directions when said feeder rollers nip said first or second margin portion of said recording material;

while said recording material is conveyed in said first direction for three times serially by advancing said first margin portion, heating and coloring said third, second and first coloring layers in sequence in a frame-sequential manner with a thermal head;

applying said electromagnetic rays of said first wavelength range to said recording material after coloring said third coloring layer, and applying said electromagnetic rays of said second wavelength range to said recording material after coloring said second coloring layer;

after coloring said first coloring layer, conveying said recording material in said first direction for ejecting said recording material;

while said recording material is conveyed in said first direction for ejection, applying said electromagnetic rays of said second wavelength range to said recording material;

while said second margin portion comes past a ray applying region of said electromagnetic rays of said second wavelength range, intermittently conveying said recording material, said recording material being then ejected.

26. A thermal printing method of recording an image on thermosensitive recording material, wherein said recording material has a sheet shape with first and second margin portions, and includes a support, and at least first to third coloring layers, overlaid on said support in sequence, and colorable with heat in colors different from each other, said third and second coloring layers being fixable with electromagnetic rays of respectively first and second wavelength ranges, said thermal printer comprising steps of:

conveying said recording material with a supply roller by advancing said second margin portion;

when said second margin portion is confronted with a fixer, stopping said supply roller for a predetermined time;

while said supply roller is stopped, applying said electromagnetic rays of said second wavelength range to said recording material, to fix said second margin portion;

conveying said recording material back and forth in first and second directions with a pair of feeder rollers, said feeder rollers nipping said recording material from said supply roller, said second direction being reverse to said first direction, and said pair of said feeder rollers being changed over between said first and second directions when said feeder rollers nip said first or second margin portion of said recording material;

while said recording material is conveyed in said first direction for three times serially by advancing said first margin portion, heating and coloring said third, second and first coloring layers in sequence in a frame-sequential manner with a thermal head;

applying said electromagnetic rays of said first wavelength range to said recording material after coloring said third coloring layer, and applying said electromagnetic rays of said second wavelength range to said recording material after coloring said second coloring layer; and after coloring said first coloring layer, conveying said recording material in said first direction for ejecting said recording material.

* * * * *